United States Patent [19]

Van Steenwyk et al.

[11] Patent Number: 4,471,533

[45] Date of Patent: Sep. 18, 1984

[54] WELL MAPPING SYSTEM AND METHOD WITH SENSOR OUTPUT COMPENSATION

[75] Inventors: Donald H. Van Steenwyk, San Marino; Paul W. Ott, Pasadena, both of Calif.

[73] Assignee: Applied Technologies Associates, San Marino, Calif.

[21] Appl. No.: 241,708

[22] Filed: Mar. 9, 1981

[51] Int. Cl.[3] ..... GOIC 9/00

[52] U.S. Cl. ..... 33/302

[58] Field of Search ..... 33/304, 312, 313, 321, 33/324, 125 T, 301, 302, 315

[56] References Cited

U.S. PATENT DOCUMENTS

| | | | |
|---|---|---|---|
| 2,303,641 | 12/1942 | Horstmann | 33/315 |
| 2,309,905 | 2/1943 | Irwin et al. . | |
| 2,450,060 | 9/1948 | Ring | 33/315 X |
| 2,635,349 | 4/1953 | Green . | |
| 2,674,049 | 4/1954 | James, Jr. . | |
| 2,681,567 | 6/1954 | Widess . | |
| 2,806,295 | 9/1957 | Ball . | |
| 3,037,295 | 6/1962 | Roberson . | |
| 3,052,029 | 9/1962 | Wallshein . | |
| 3,137,077 | 6/1964 | Rosenthal . | |
| 3,241,363 | 3/1966 | Alderson et al. . | |
| 3,308,670 | 3/1967 | Granqvist . | |
| 3,561,129 | 2/1971 | Johnston . | |
| 3,753,296 | 8/1973 | Van Steenwyk . | |
| 3,894,341 | 7/1975 | Kapeller . | |
| 4,141,149 | 2/1979 | George et al. | 33/125 T |
| 4,199,869 | 4/1980 | Van Steenwyk | 33/304 |

*Primary Examiner*—William D. Martin, Jr.

*Attorney, Agent, or Firm*—William W. Haefliger

[57] ABSTRACT

Bore-hole mapping, or surveying, or tool steering in a bore-hole is accomplished using selected combinations of sensors, with sensor signal compensation being provided, in the hole or at the surface. Typical sensors include an angular rate sensor or sensors, a linear acceleration sensor or sensors, and an angular acceleration sensor or sensors. The sensor group is typically rotated in the bore-hole, and the sensors may have selected sensitive axis angularity relative to the travel axis in the bore-hole.

47 Claims, 34 Drawing Figures

COMPUTER (TILT) ~91~
COMPUTER (AZIMUTH) ~90~
θ TILT
ψ AZIMUTH
ANGULAR RATE SENSOR
COMP. CIRCUIT
LINEAR ACCEL. SENSOR
CONV. CIRCUIT
COMP. CIRCUIT
MASTER CONTROL
TO SWITCHES
ANGULAR ACCEL. SENSOR
CO-ORD. CONVERSION CIRCUIT 150
131
131a
132
132a
133a
115
117
216
116
113
134a
134
135
133
110
181
124
111
113
110
114
170
170
129
180
M
122
123
127
124
125a
125
G1
123a
127a
125a
G2
118
112
225
128
123b
170
126a
A1
126
120
128a
123c
A2
226
226a
121
211
123d
214
210
221
212
220
119

124
146

GYRO G2 OUTPUT
139a
GYRO G1 OUTPUT
139b
N
W
S
E
145
ACCEL A2 OUTPUT
145 A
ACCEL A1 OUTPUT

153
A3
A1
A2
124
250
127
142
144
125
143
136
145
138
149
145a
148
146
141
137
G
A3
140
123a
125a
127
250
141
A3
225
Ge
137
123b
136
A1
A2
A3
154

A3
143
144
G
A1
Y
138
139
138
136
143
139
141
A2
X
W 146
146a
147a
A1
124
145
147
150
A2
149

WELL MAPPING SYSTEM AND METHOD WITH SENSOR OUTPUT COMPENSATION

BACKGROUND OF THE INVENTION

This invention relates generally to mapping apparatus and methods, and more particularly concerns well mapping employing a probe which may be inserted into a bore-hole or well, for surveying and/or for tool steering. In addition, it concerns method and apparatus to determine the probe's degree of tilt from vertical and to relate the latter to sensor generated azimuth information, at all latitudes and at all instrument attitudes. Further, the azimuth determining apparatus by itself or in combination with the tilt measuring apparatus, may be housed in a carrier of sufficiently small diameter to permit insertion directly into available small I. D. drill tubing, thus eliminating the need to remove the tubing to enable such mapping.

In the past, the task of position mapping a well or bore-hole for azimuth in addition to tilt has been excessively complicated, very expensive, and often inaccurate because of the difficulty in accommodating the size and special requirements of the available instrumentation. For example, magnetic compass devices typically require that the drill tubing be fitted with a few tubular sections of non-magnetic material, either initially or when drill bits are changed. The magnetic compass device is inserted within this non-magnetic section and the entire drill stem run into the hole as measurements are made. These non-magnetic sections are much more expensive than standard steel drill stem, and their availability at the drill site must be pre-planned. The devices are very inaccurate where drilling goes through magnetic materials, and are unusable where casing has been installed.

Directional or free gyroscopes are deployed much as the magnetic compass devices and function by attempting to remember a pre-set direction in space as they are run in the hole. Their ability to initially align is limited and difficult, and their capability to remember degrades with time and environmental exposure. Also, their accuracy is reduced as instrument size is reduced, as for example becomes necessary for small well bores. Further, the range of tilt and azimuthal variations over which they can be used is restricted by gimbal freedom which must be limited to prevent gimbal lock and consequent gyro tumbling.

A major advance toward overcoming these problems is described in my U.S. Pat. No. 3,753,296. That invention provides a method and means for overcoming the above complications, problems, and limitations by employing that kind and principal of a gyroscope known as a rate-of-turn gyroscope, or commonly 'a rate gyro', to remotely determine a plane containing the earth's spin axis (azimuth) while inserted in a bore-hole or well. The rate gyroscope has a rotor defining a spin axis; and means to support the gyroscope for travel in a bore-hole and to rotate about an axis extending in the direction of the hole, the gyroscope characterized as producing an output which varies as a function of azimuth orientation of the gyroscope relative to the earth's spin axis. Such means typically includes a carrier containing the gyroscope and a motor, the carrier being sized for travel in the well, as for example within the drill tubing. Also, circuitry is operatively connected with the motor and carrier to produce an output signal indicating azimuthal orientation of the rotating gyroscope relative to the carrier, whereby that signal and the gyroscope output may be processed to determine azimuth orientation of the carrier and any other instrument thereon relative to the earth's spin axis, such instrument for example comprising a well logging device such as a radiometer, inclinometer, etc.

U.S. Pat. No. 4,199,869 improves upon U.S. Pat. No. 3,753,296 in that it provides for the obtaining of a very high degree of accuracy as respects derived azimuth and tilt information for all latitudes and angularities of bore-holes; the application of one or more two-degree of freedom gyroscopes as a "rate gyro" or rate gyros, for use in well mapping; the use of two such gyros in different attitudes to obtain cross-check azimuth information; and the provision of highly compact instrumentation which is especially needed for smaller diameter bore-holes.

While the devices of the above two patents are highly useful, they lack the unusual features and advantages of the present invention, among which are: compensation for certain errors in the outputs of the angular rate sensor or sensors, and in the outputs of the tilt or acceleration sensor or sensors. Typical of such errors are bias errors, acceleration sensitive errors and acceleration squared errors, and temperature and time induced errors.

SUMMARY OF THE INVENTION

It is a major object of the present invention to provide method and apparatus facilitating compensation for such errors. Typically, apparatus embodying the invention comprises:

(a) a carrier movable in the bore hole, (b) angular rate sensor means on the carrier and having an output, (c) an acceleration sensor means on the carrier and having an output, and (d) circuit means operatively connected with the sensor means for compensating signals derived from the output of at least one of the sensor means in accordance with the values of signals derived from the output of the other sensor means, to produce compensated signals.

As will be seen, the circuit means may be connected with the sensor means to adjust angular rate signals derived from the output of the angular rate sensor thereby to compenstate for acceleration effects associated with acceleration signals derived from the output of the acceleration sensor means, so as to produce corrected angular rate values. Alternatively, or additionally, the circuit means may be connected with the sensor means to adjust acceleration signals derived from the output of the acceleration sensor means to compensate for angular rate effects associated with angular rate signals derived from the output of the angular rate sensor means, thereby to produce corrected acceleration values.

In addition, temperature compensating circuit means may be provided to compensate signals derived from one or both of the sensors in accordance with temperature changes encountered in the bore-hole; and time compensating circuit means may also or alternatively be provided to compensate signals derived from one or both of the two sensor means, in accordance with time values. Such temperature and time corrections may be modeled, or calibrated, as functions of conditions encountered in the bore-hole.

Further, coordinate conversion circuit means may be operatively connected with the acceleration sensor means to convert outputs of the acceleration sensor means along three axes to values $a_1$, $a_2$ and $a_3$ along three selected axes. Also, angular acceleration values may be obtained for compensation purposes.

Finally, means is provided to receive the corrected angular rate values and to produce an output which varies as a function of azimuth orientation of the angular rate sensor means.

These and other objects and advantages of the invention, as well as the details of an illustrative embodiment, will be more fully understood from the following description and drawings, in which:

DRAWING DESCRIPTION

FIG. 1*a* is a block diagram;
FIG. 1*b* is a block diagram;
FIG. 2*a* is a block diagram;
FIG. 2*b* is a block diagram;
FIG. 3 is a circuit diagram;
FIGS. 4 and 5 are co-ordinate diagrams;
FIGS. 6 and 7 are circuit diagrams;
FIGS. 8*a* -8*c* are elevations taken in bore-holes;
FIG. 9 is an elevation taken in section to show use of one form of instrumentation, in well mapping;
FIG. 10 is a diagram indicating tilt of the well mapping tool in a slanted well;
FIG. 11 is a wave form diagram;
FIG. 12 is an enlarged vertical section showing details of two gyrocompasses as may be used in the apparatus of FIG. 9;
FIG. 12*a* is a diagrammatic representation of the $G_1$ accelerometer in FIG. 12;
FIG. 12*b* is a quadrant diagram;
FIG. 13 is a diagrammatic showing of the operation of one of the two accelerometers of FIG. 9, under instrument tilted conditions;
FIG. 14 is a view like FIG. 9 showing a modification in which one of the rate gyros of FIG. 4 is used;
FIG. 15 is a view like FIG. 9 showing a modification in which the other of the rate gyros of FIG. 12 is used;
FIG. 16 is a wave form diagram;
FIG. 17 is a schematic diagram;
FIG. 18 is a wave form diagram;
FIG. 19 is a schematic diagram;
FIG. 20 is a schematic diagram;
FIGS. 21 and 22 are elevations showing use of the apparatus for drill steering;
FIG. 23 is a block diagram, and
FIGS. 24–28 are elevations.

DETAILED DESCRIPTION

Figures 1A, 1B:
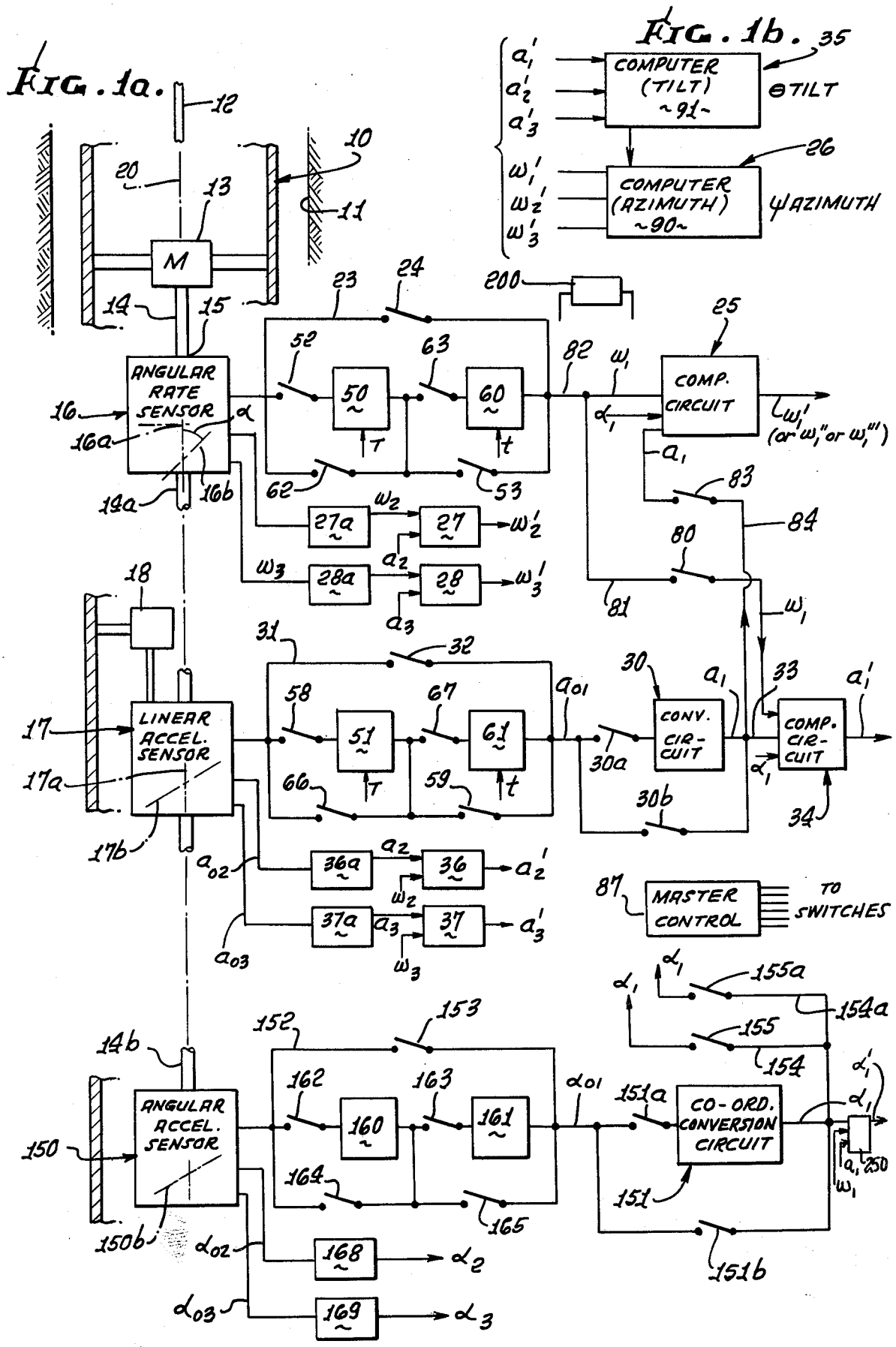

Referring to FIG. 1*a*, a carrier 10 is movable in a bore-hole indicated at 11. Means to travel the carrier lengthwise in the hole is indicated at 12. A motor or other manipulatory means is indicated at 13 as carried by the carrier, and its rotary output shaft 14 is shown as connected at 15 to an angular rate sensor means 16. The shaft may be extended at 14*a* for connection to an acceleration sensor means 17. Alternatively, the means 17 may be manipulated by a motor or manipulator 18 also carried by the carrier 10.

Figure 4:
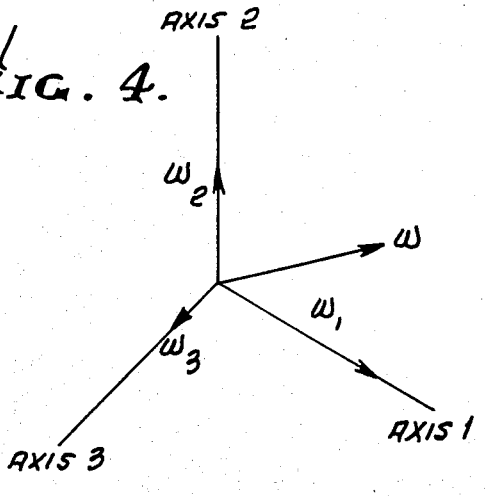

The angular rate sensor means 16 may for example take the form of one or more of the following known devices; however, the term "angular rate sensor means" is not limited to such devices:

1. Single degree of freedom rate gyroscope
2. Tuned rotor rate gyroscope
3. Two axis rate gyroscope
4. Nuclear spin rate gyroscope
5. Sonic rate gyroscope
6. Vibrating rate gyroscope
7. Jet stream rate gyroscope
8. Rotating angular accelerometer
9. Integrating angular accelerometer
10. Differential position gyroscopes and platforms
11. Laser gyroscopes
12. Combination rate gyroscope and linear accelerometer Examples of angular rate sensors include the gyroscopes disclosed in U.S. Pat. Nos. 3,753,296 and 4,199,869, having the functions disclosed therein. Each such device may be characterized as having a "sensitive axis" which is the axis about which rotation occurs to produce an output which is a measure of rate-of-turn or angular rate $\omega$. That value may have components $\omega_1$, $\omega_2$, and $\omega_3$ in a three axis coordinate system as shown in FIG. 4, for example. The sensitive axis may be generally normal to the axis 20 of instrument travel in the bore-hole (see sensitive axis 16*a* in FIG. 1*a*), or it may be canted at some angle $\alpha$ relative to axis 20 (see canted sensitive axis 16*b* in FIG. 1*a*).

The acceleration sensor means 17 may for example take the form of one or more of the following known devices; however, the term "acceleration sensor means" is not limited to such devices:

1. one or more single axis accelerometers
2. one or more dual axis accelerometers
3. one or more triple axis accelerometers Examples of acceleration sensors include the accelerometers disclosed in U.S. Pat. Nos. 3,753,296 and 4,199,869, having the functions disclosed therein. Such sensors may be supported to be orthogonal or canted relative to the carrier axis. They may be stationary or carouseled, or may be otherwise manipulated, to enhance accuracy and/or gain an added axis or axes of sensitivity. An axis of sensitivity, viewed endwise, and normal to axis 20, is seen at 17*a* in FIG. 1*a*; and a canted axis of sensitivity is shown at 17*b*, these being examples only. The axis of sensitivity is the axis along which acceleration measurement occurs. Sensitivity here is as to tilt.

Referring again to angular rate sensor 16, it may produce one output $\omega_1$, i.e. one output of angular rate, or it may produce two or three components, as for example the components of $\omega$ along the three axes shown in FIG. 4. Considering one component $\omega_1$, it may be directly passed via path 23 and switch 24 to input to the compensation circuit means 25. The latter processes $\omega_1$ and produces a corresponding output $\omega_1'$. In FIG. 1*b* computer 26 receives inputs $\omega_1$, $\omega_2$, and $\omega_3'$ to produce azimuth output $\psi$. Inputs $\omega_2'$ and $\omega_3'$ are derived from compensation circuits indicated at 27 and 28, and which correspond to circuitry 25.

Figure 5:
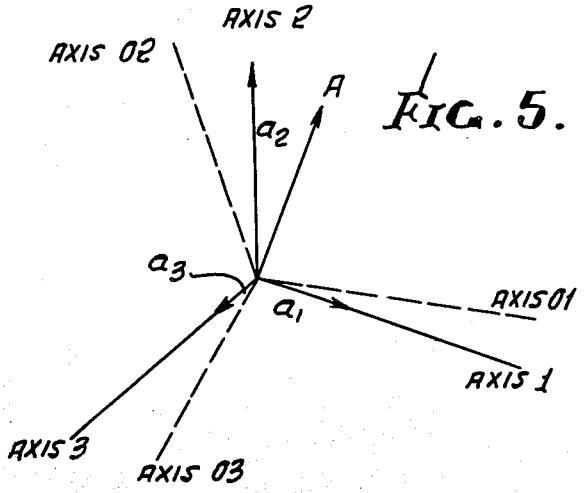
Figure 23:
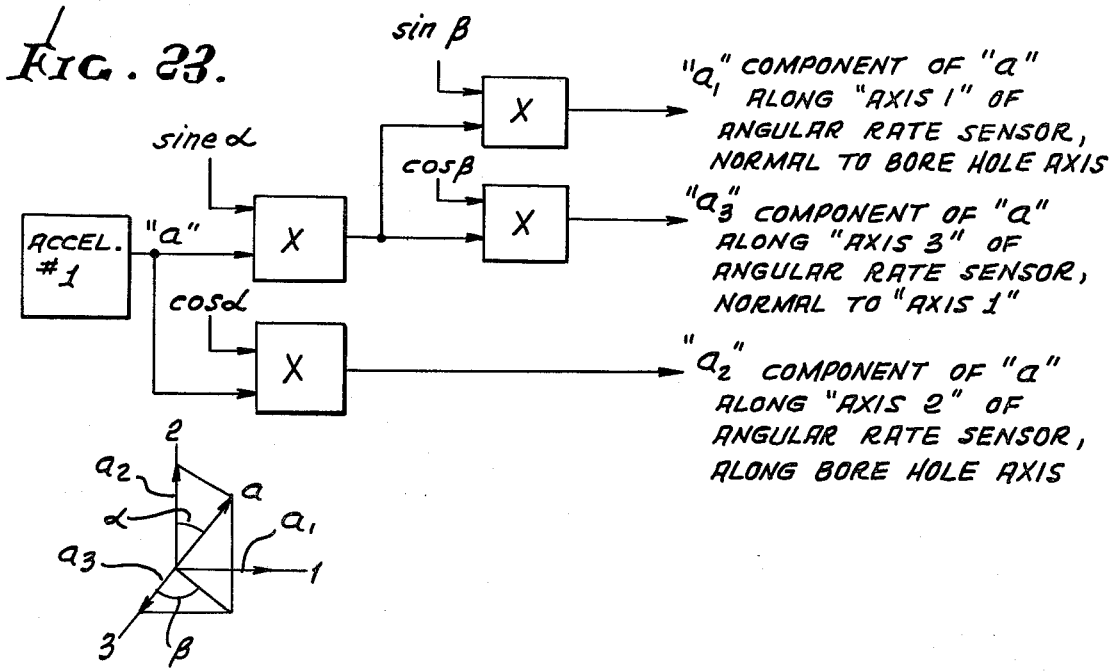

In similar manner, the acceleration sensor 17 produces an output $a_{01}$ which, after conversion at 30 becomes output $a_1$. Output $a_{01}$ is transmitted via path 31, which includes switch 32, to co-ordinate conversion circuit 30. If no conversion is required, circuit 30 is eliminated or by-passed (by opening switch 30*a* an closing switch 30*b*), and $a_{01}$ becomes the same as $a_1$. The sensor 17 may also produce component outputs $a_{02}$ and $a_{03}$, which after conversion beome $a_2$ and $a_3$ respectively. The sum of the component vectors corresponding to $a_{01}$, $a_{02}$ and $a_{03}$ equals the acceleration vector, and the sum of the component vectors $a_1$, $a_2$, and $a_3$ also equals the acceleration vector. The reason for converting to $a_1$, $a_2$ and $a_3$ is to produce components in the same co-ordinate system as $\omega_1$, $\omega_2$ and $\omega_3$, i.e. the $\omega$ system. See FIG. 5 in this regard. Circuitry 30 is well known, one resolver version being shown in FIG. 23, with multipliers as indicated. A similar co-ordinate conversion may be performed upon $\omega_1$, as by means 200 connectible in series in path 201, to convert $\omega_1$ (and also $\omega_2$ and $\omega_3$) into coordinates the same as the coordinates of $a_1$, $a_2$, and $a_3$; and devices 30 and 200 may be used to convert into another or third coordinate system.

In FIG. 1*a*, output $a_1$ is directly passed via path 33 to input to the compensation circuit means 34. The latter processes $a_1$, and produces a corresponding output $a_1'$. Computer 35 receives inputs $a_1'$, $a_2'$ and $a_3'$ to produce tilt output $\phi$. Inputs $a_2'$, and $a_3'$ are derived from compensation circuits indicated at 36 and 37, and which correspond to circuitry 34.

Further, an angular acceleration sensor 150 may also be connected to shaft 14 via shaft extension 14*b*, to be rotated with the sensors 16 and 17, and it may have its sensitive axis (about which angular acceleration is measured) parallel to the shaft 14 (generally parallel to the bore-hole), or canted relative thereto (see canted axis 150*b*).

The angular acceleration sensor produces an output $\alpha_{01}$ which, after co-ordinate conversation at 151 (like converter 30) becomes output $\alpha_1$. Output $\alpha_{01}$ is transmitted via path 152, which includes switch 153, to co-ordinate conversion circuit 151. If no conversion is required, circuit 151 is eliminated or by-passed (by opening switch 151*a* and closing switch 151*b*), and $\alpha_{01}$ then becomes the same as $\alpha_1$. The sensor 150 may also produce component outputs $\alpha_{02}$ and $\alpha_{03}$, which after conversion become $\alpha_2$ and $\alpha_3$ respectively. The sum of the component vectors corresponding to $\alpha_{01}$, $\alpha_{02}$ and $\alpha_{03}$ equals the angular acceleration vector, and the sum of the converted vectors $\alpha_1$, $\alpha_2$ and $\alpha_3$ also equals the angular acceleration vector. Such conversion produces components in the same co-ordinate system as $\omega_1$, $\omega_2$ and $\omega_3$, i.e., the "$\omega$" system. Devices 30, 200 and 151 may be used to convert into another or third co-ordinate system.

In accordance with an important aspect of the invention, any of the compensation circuits 25, 27, 28, 34, 36 and 37 may be regarded as a compensation means operatively connected with the sensor means (as for example sensor 16, 17 and 150) for compensating signals derived from the output of at least one of the sensor means (one of 16, 17 and 150, for example) in accordance with values of signals derived from other of the sensor means (the other of 16, 17 and 150, for example), to produce compensated signals. Thus, for example the circuit means is connected with the sensor means to adjust angular rate signals derived from the output of the angular rate sensor thereby to compensate for acceleration effects associated with acceleration signals derived from the output of the acceleration sensor means, so as to produce corrected angular rate values. The compensation means may be indicated at 25 to adjust angular rate signals $\omega_1$ derived from the output of the angular rate sensor 16, thereby to compensate for acceleration effects associated with acceleration signals (as at $a_1$) derived from the output of the acceleration sensor means, to produce corrected angular rate values, $\omega_1'$. This correction removes the influence of gravity from the angular rate value, for example. Also, corrected values $\omega_1''$ and $\omega_1''$ may be produced, as described.

Figure 2A:
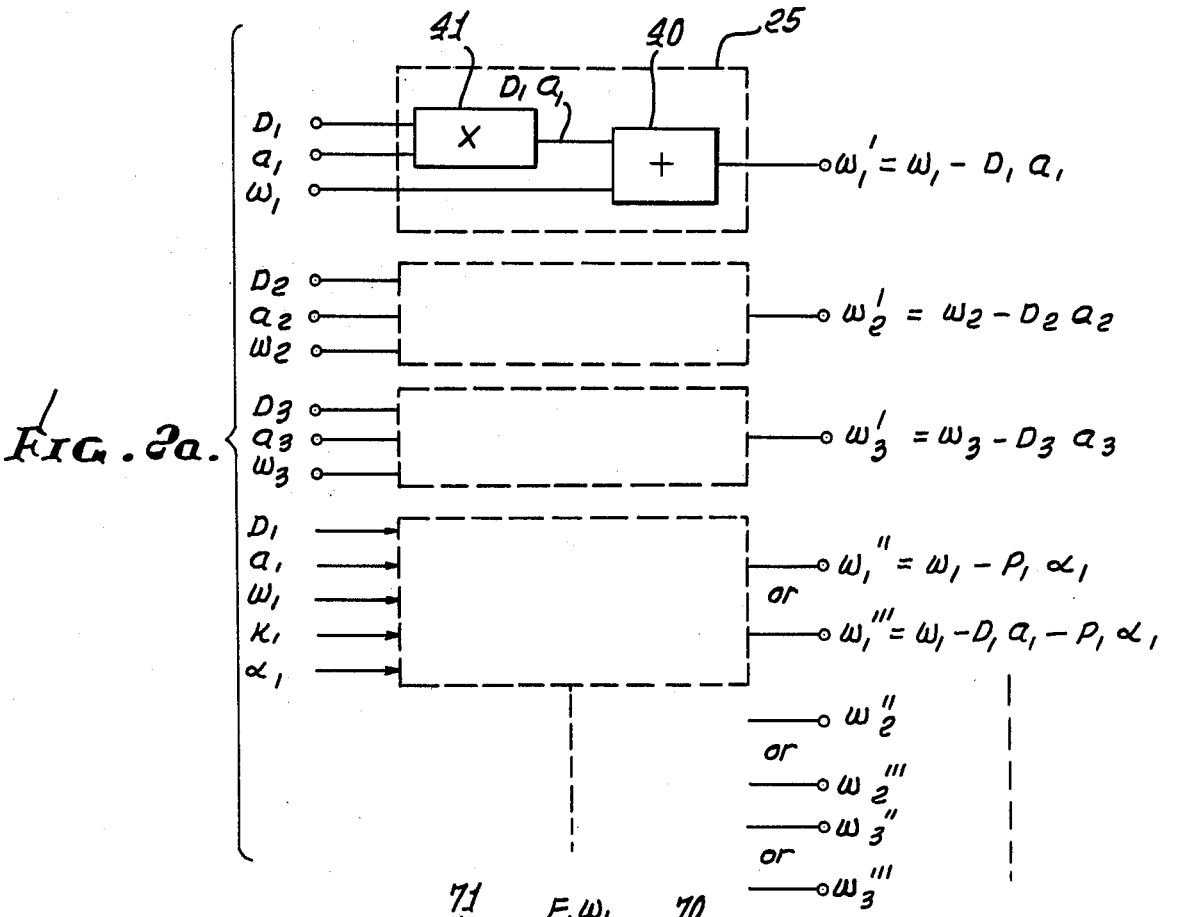
Figure 3:
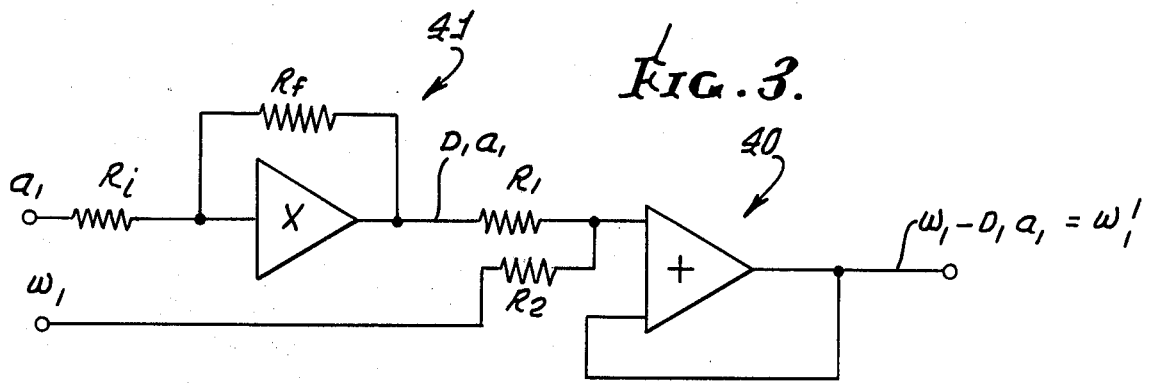

Referring to FIG. 2*a* the compensating circuit 25 may typically include summing circuitry at 40 to sum an angular rate signal $\omega_1$ along a selected coordinate axis (axis 1 for example), and a signal $D_1a_1$ along that axis, where $D_1$ is a constant and $a_1$ is a value corresponding to the output of the acceleration sensor 17. The value $D_1a_1$ is produced by a multiplying circuit 41 in FIG. 2*a*, the inputs to which are $D_1$ and $a_1$, as indicated, an the output of circuit 40 is the compensated value $\omega_1'=\omega_1-D_1a_1$. Similar compensated output values $\omega_2'=\omega_2-D_2a_2$ along axis 2, and $\omega_3'=\omega-D_3a_3$ are shown in FIG. 1. $D_1$ may be generated in circuit 25, for example, $D_2$ may be generated in 27, and $D_3$ in 28. FIG. 3 shows one specific form of circuitry 40 and 41, in the form of summing and multiplying amplifiers, although digital devices may alternatively be employed. In amplifier 41, $D_1=1+(R_f/R_i)$, the resistors $R_f$ and $R_i$ being connected as shown.

In FIG. 1*a*, output $\alpha_1$ from angular acceleration sensor 150 is directly and selectively passed via path 154 and switch 155 to the compensation circuit 25, and via path 154*a* and switch 155*a* to the compensation circuit 34. When passed to circuit 25, it compensates the angular rate $\omega_1$ to produce compensated output value $\omega_1''=\omega_1-P_1\alpha_1$, and where $\omega_1$ is also compensated by linear acceleration $a_l$, then the compensated output value becomes $\omega_1''=\omega_1-D_1a_1-P_1\alpha_1$. In other words, the output of the angular rate sensor is compensated for both linear and angular acceleration values. In similar manner, the output $\alpha_2$ may be used to produce $\omega_2''=\omega_2-P_2\alpha_2$, and $\omega_2''=\omega_2-D_2a_2-P_2\alpha_2$, and the output $\alpha_3$ may be used to produce $\omega_3''=\omega_3-P_3\alpha_3$, and $\omega_3''=\omega_3-D_3a_3-P_3\alpha_3$.

Figure 6:
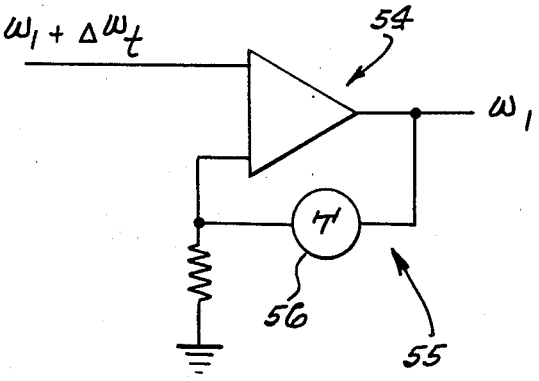

Also associated with the apparatus of FIG. 1*a* is temperature compensating circuit means to compensate signals derived from at least one, or both, of the sensors 16 and 17 in accordance with temperature changes encountered in the bore-hole. See for example the circuitry 50 associated with sensor 16, and circuitry 51 associated with sensor 17. When switches 52 and 53 are closed, and switch 24 open, the output of sensor 16 passes through circuitry 50 and to compensating circuitry 25 previously discussed. Thus, if the output of sensor 16 is undesirably increased by an amount $\Delta\omega_t$ due to bore-hole high temperature, the circuitry 50 eliminates $\Delta\omega_t$ from that output. Known circuitry to produce such compensation may take the general form of the amplifier 54 in FIG. 6, having a feedback circuit 55 with a thermistor 56 connected as shown, this being one example only. Thermistor 56 is exposed to sensor temperature. A similar temperature compensating circuit 51 and switches 58 and 59, are shown in association with sensor 17, to suppress temperature increases $\Delta a_1$ added to the output $a_1$ of sensor 17.

Figure 7:
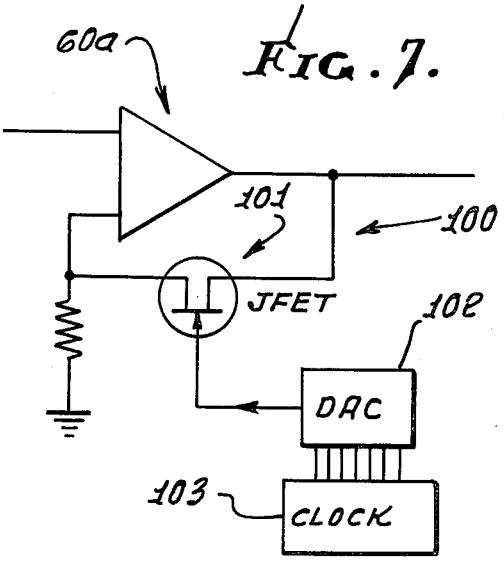

In addition, time compensating circuit means is shown in association with the sensors 16 and 17 to compensate their outputs in accordance with selected time values. See for example the time compensating circuit 60 associated with sensor 16, and circuitry 61 associated with sensor 17. When switches 62 and 63 are closed, and switches 52, 24 and 53 are open, the output of sensor 16 passes through circuitry 60, and to compensation circuitry 25 discussed above. Thus, for example, if the voltage output of sensor 16 degrades or diminishes in amplitude over a period of time, it may be restored by circuit 60. FIG. 7 shows one example of a time compensating (gain restorative) circuit with a feedback circuit 100 containing JFET 101 controlled by digital-to-analog converter 102 driven by clock 103. There are other examples of time compensation, including phase shift, etc.

If desired, switches 52 and 63 may be closed and switches 24, 62 and 63 opened, to pass the output of 16 through both compensators 50 and 60 for both temperature and time compensation.

Similar time compensation switches are shown at 36 and 37 in association with sensor 17.

The temperature and time compensation circuits for the output of sensor 150 appear at 160 and 161 (and correspond to 51 and 61) and switches appear at 162, 163 164 and 165 and 166 to correspond to switches 58, 67, 66, and 59. Each of blocks 168 and 169 respectively in series with inputs $\alpha_{02}$ and $\alpha_{03}$ represents temperature and time circuits, like 160 and 161, and associated switches.

Figure 2B:
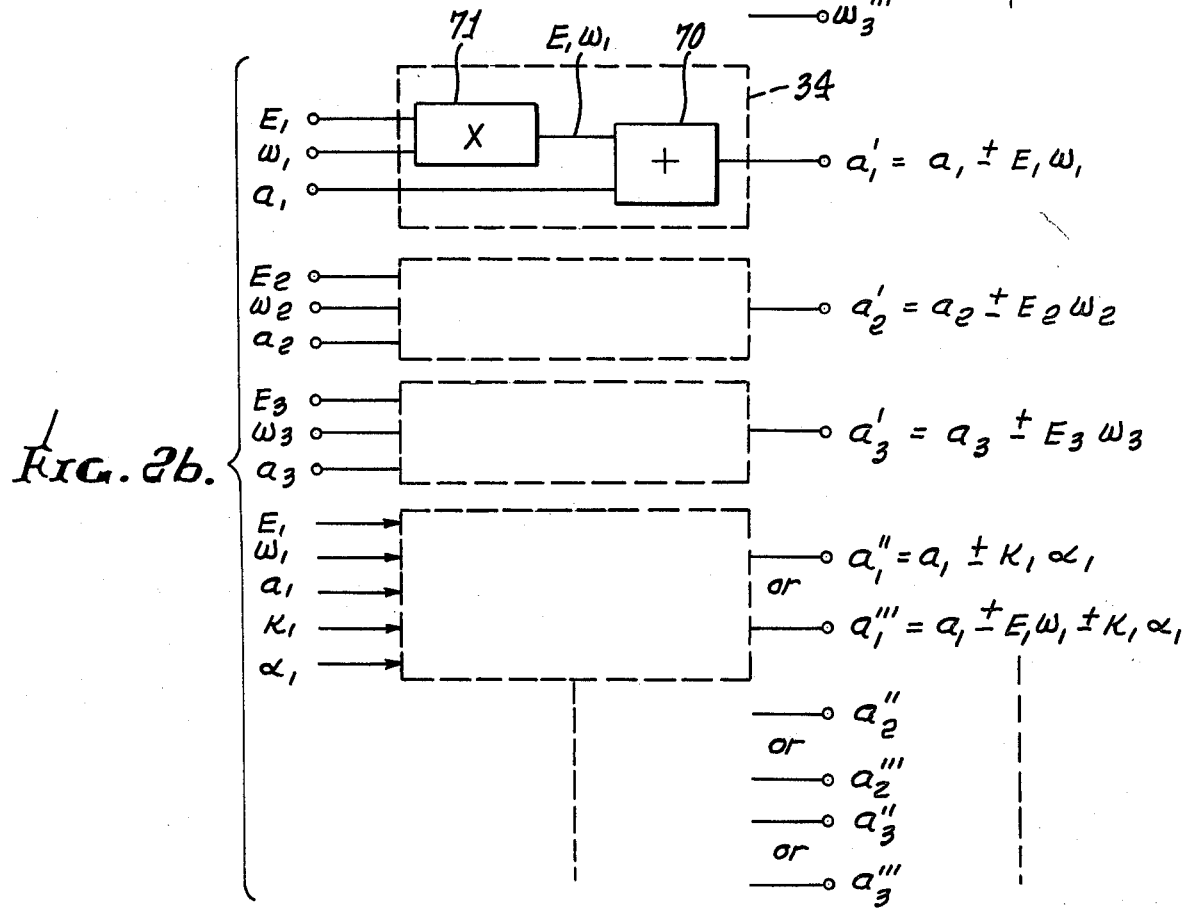

The above discussed compensation means 34 is shown as operatively and selectively connected with the sensors 16, 17 and 150 to adjust acceleration signals $a_1$ derived from the output of the acceleration sensor 17 to compensate for angular rate effects associated with angular rate signals $\omega_1$ derived from the output of the angular rate sensor 16, and also to selectively compensate for angular acceleration effects associated with angular acceleration signals $\alpha_1$ derived from sensor 150, thereby to produce corrected acceleration values $a_1'$. Referring to FIG. 2*b*, the compensator 34 may be similar to compensator 25 (FIG. 2*a*) in that it also includes a summing circuit 70 to sum $a_1$ and $E_1\omega_1$, and a multiplier circuit 71 to receive $E_1$ and $\omega_1$ and produce the product $E_1\omega_1$, where $E_1$ is a selected constant. Thus, corrected $a_1'=a_1\pm E_1\omega_1$. The value $E_1$ may for example be a calibrating value such as to produce the desired $a_1'$ which is found in practice to be influenced by $\omega_1$. Compensation circuits like 34 are provided at 36 and 37 to respectively produce:

$$a_2'=a_2\pm E_2\omega_2, \text{ and}$$

$$a_3'=a_3\pm E_3\omega_3$$

If the angular acceleration correction is used, then the following corrected linear acceleration values are achieved:

$$a_1''=a_1\pm K_1\alpha_1$$

$$a_2''=a_2\pm K_2\alpha_2$$

$$a_3''=a_3\pm K_3\alpha_3$$

or, alternatively, for both $\omega+\alpha$ correction:

$$a_1'''=a_1\pm E_1\omega_1\pm K_1\alpha_1$$

$$a_2'''=a_2\pm E_2\omega_2\pm K_2\alpha_2$$

$$a_3'''=a_3\pm E_3\omega_3\pm K_3\alpha_3$$

Similarly, compensation means 250 is shown as operatively and selectively connectible with the sensors 16, 17 and 150 to adjust angular acceleration signals $\alpha_1$ derived from the output of the angular acceleration sensor 150 to compensate for angular rate effects associated with angular, rate signals $\omega_1$ derived from the output of the angular rate sensor 16, and also to selectively compensate for linear acceleration effects associated with acceleration signals $a_1$ derived from sensor 17, thereby to produce corrected angular acceleration values $\alpha_1'$. The compensator 250 may be similar to compensator 25 (FIG. 2*a*) in that it also includes a summing circuit and a multiplier circuit to receive $F_1$ and $\omega_1$ and produce the product $F_1\omega_1$, where $F_1$ is a selected constant. Thus, corrected $\alpha_1'=\alpha_1\pm F_1\omega_1$. The value $F_1$ may for example be a calibrating value such as to produce the desired $\alpha_1$, which is found in practice to be influenced by $\omega_1$. Compensation circuits like 250 are similarly provided to respectively produce:

$$\alpha_2'=\alpha_2\pm F_2\omega_2, \text{ and}$$

$$\alpha_3'=\alpha_3\pm F_3\omega_3$$

Correction for both $\omega$ and "a" may be provided in the manner discussed above.

Each of blocks 27*a* and 28*a* respectively in series with compensation circuits 27 and 28 represents temperature and time circuits like 50 and 60 and associated switches. Likewise, each of blocks 36*a* and 37*a* respectively in series with compensation circuits 36 and 37 represents circuits like 51, 61, 30 and associated switches. Blocks 27 and 36 have cross over connections corresponding to connections 81 and 84, and blocks 28 and 37 also have such cross-over connections. Each of blocks 168 and 169 corresponds to the temperature and time compensators 160 and 161.

Note also in FIG. 1*a* the switch 80 in the cross-over path 81 extending from the $\omega_1$ input path 82 to compensator 25, to provide $\omega_1$ input to compensator 34; and the switch 83 in the cross-over path 84 extending from the $a_1$ input path 33 to compensator 34, to provide $a_1$ input to compensator 25.

Some or all of the switches shown in FIG. 1*a* may be suitably and selectively controlled from a master control 87, either in the bore-hole or at the bore-hole surface. Thus, for example, either or both of the compensators 25 and 34 may be employed to compensate as described, by control of switches 80 and 83; and various ones or combinations of the temperature and time compensators may be employed, or excluded, by selective operation of the switches associated therewith, as described and shown.

Figure 8A:
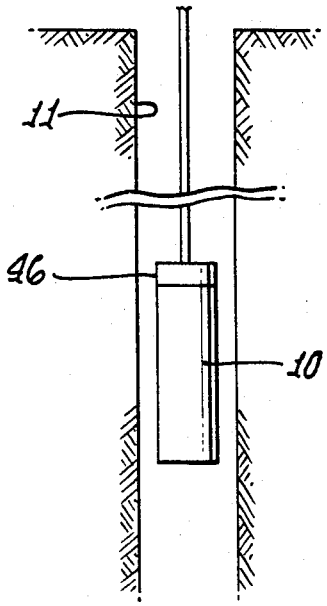
Figure 8B:
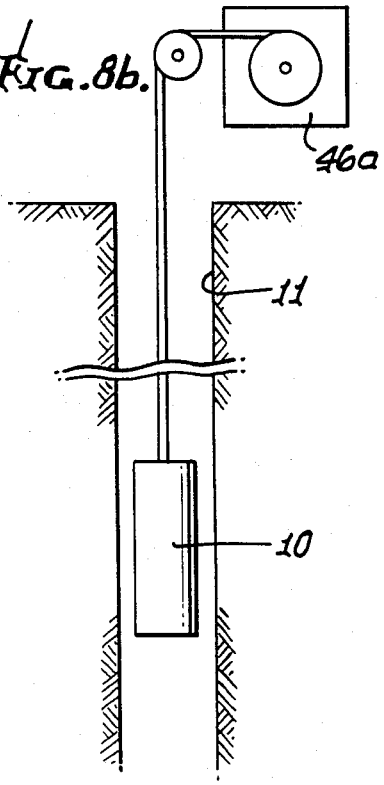
Figure 8C:
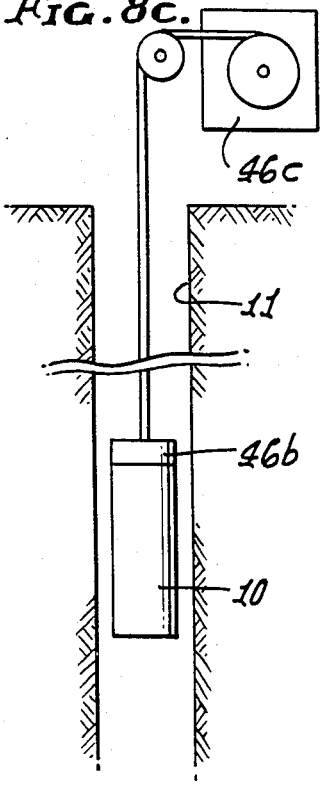

The described circuitry connected to the outputs of the sensors 16 and 17 may be located in the bore-hole (as on the carrier) outside the bore-hole (as at the well surface) or partly in the hole and partly out. See for example FIG. 8*a* showing such circuity at 46 on the carrier 10 in the bore-hole 11; FIG. 8*b* showing such circuitry at 46*a* outside the hole; and FIG. 8*c* showing such circuitry one part 46*b* of which is on the carrier in the hole and another part 46*c* of which is at the well surface, outside the hole.

FIG. 1*b* shows circuit means, such as a computer 90, connected with one or more of the compensation circuits 25, 27 and 28, to receive corrected angular rate values $\omega_1'$, $\omega_2'$ and $\omega_3'$ and to produce an output which varies as a function of azimuth orientation of the sensor 16. Operation of the computer is as generally described below. Also, FIG. 1*b* shows circuit means, such as a computer 91, connected with one or more of the compensation circuits 34, 36 and 37 to receive corrected acceleration values $a_1'$, $a_2'$ and $a_3'$, and to produce an output which varies as a function of tilt of the acceleration sensor means. Operation of the computer 91 is as generally described below.

The compensation principles as discussed above may be applied not only to a system which includes one angular rate sensor, but also to two or more angular rate sensors, each or either of which may be connected in compensating relation with an accelerometer or tilt detector. Thus, one or more accelerometers may be employed. FIGS. 9–16 below, and their accompanying description, refer to a two angular rate sensor system, wherein rate gyroscopes are employed.

Figure 9:
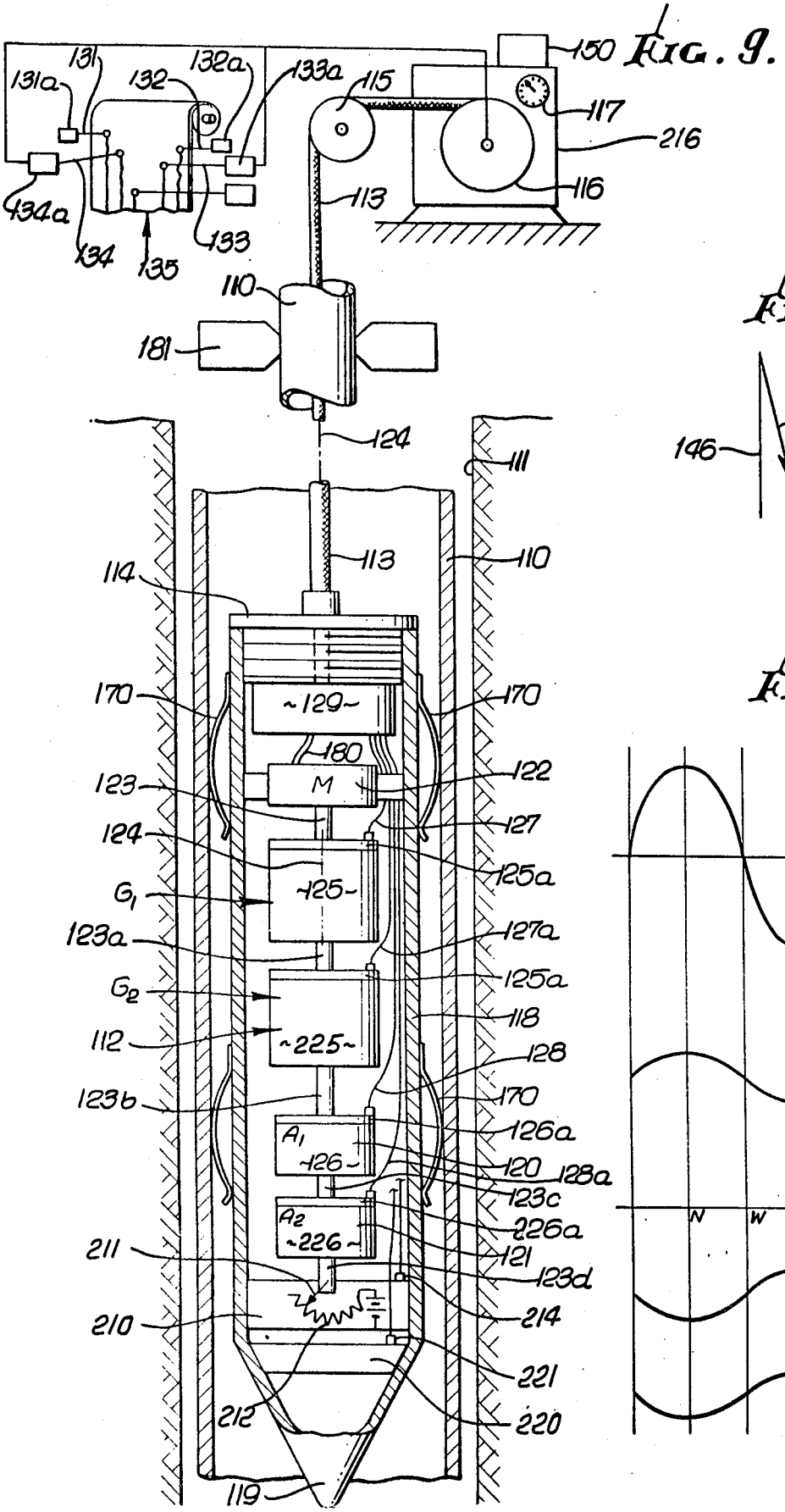

In FIG. 9, well tubing 110 extends downwardly in a well 111, which may or may not be cased. Extending within the tubing is a well mapping instrument or apparatus 112 for determining the direction of tilt, from vertical, of the well or bore-hole. Such apparatus may readily be traveled up and down the well, as by lifting and lowering of a cable 113 attached to the top 114 of the instrument. The upper end of the cable is turned at 115 and spooled at 116, where a suitable meter 117 may record the length of cable extending downwardly in the well, for logging purposes.

The apparatus 112 is shown to include a generally vertically elongated tubular housing or carrier 118 of diameter less than that of the tubing bore, so that well fluid in the tubing may readily pass, relatively, the instrument as it is lowered in the tubing. Also, the lower terminal of the housing may be tapered at 119, for assisting downward travel or penetration of the instrument through well liquid in the tubing. The carrier 118 suppoorts first and second angular sensors such as rate gyroscopes $G_1$ and $G_2$, and accelerometers 120 and 121, and drive means 122 to rotate the latter, for travel lengthwise in the well. Bowed springs 170 on the carrier center it in the tubing 110.

The drive means 122 may include an electric motor and speed reducer functioning to rotate a shaft 123 relatively slowly about a common axis 124 which is generally parallel to the length axis of the tubular carrier, i.e. axis 124 is vertical when the instrument is vertical, and axis 124 is tilted at the same angle from vertical as is the instrument when the latter bears sidewardly against the bore of the tubing 110 when such tubing assumes the same tilt angle due to bore-hole tilt from vertical. Merely as illustrative, for the continuous rotation case, the rate of rotation of shaft 124 may be within the range 0.5 RPM to 5 RPM. The motor and housing may be considered as within the scope of means to support and rotate the gyroscope and accelerometers.

Due to rotation of the shaft 123, and lower extensions **123*a*, 123*b* and 123*c* thereof, the frames 125 and 225 of the gyroscopes and the frames 126 and 226 of the accelerometers are typically all rotated simultaneously about axis 124, within and relative to the sealed housing 118. The signal outputs of the gyroscopes and accelerometers are transmitted via terminals at suitable slip ring structures 125*a*, 225*a*, 126*a* and 226*a*, and via cables 127, 127*a*, 128 and 128*a*, to the processing circuitry at 129 within the instrument, such circuitry for example including that described above, and multiplexing means if desired. The multiplexed or non-multiplexed output from such circuitry is transmitted via a lead in cable 113 to a surface recorder, as for example include pens 131–134 of a strip chart recorder 135, whose advancement may be synchronized with the lowering of the instrument in the well. The drivers 131*a*–134*a* for recorder pens 131–134** are calibrated to indicate bore-hole azimuth, degree of tilt and depth, respectively, and another strip chart indicating bore-hole depth along its length may be employed, if desired. The recorder can be located at the instrument for subsequent retrieval and read-out after the instrument is pulled from the hole.

One specific example of multiple gyroscopes will now be described, other type rate sensors being usuable.

Figure 12:
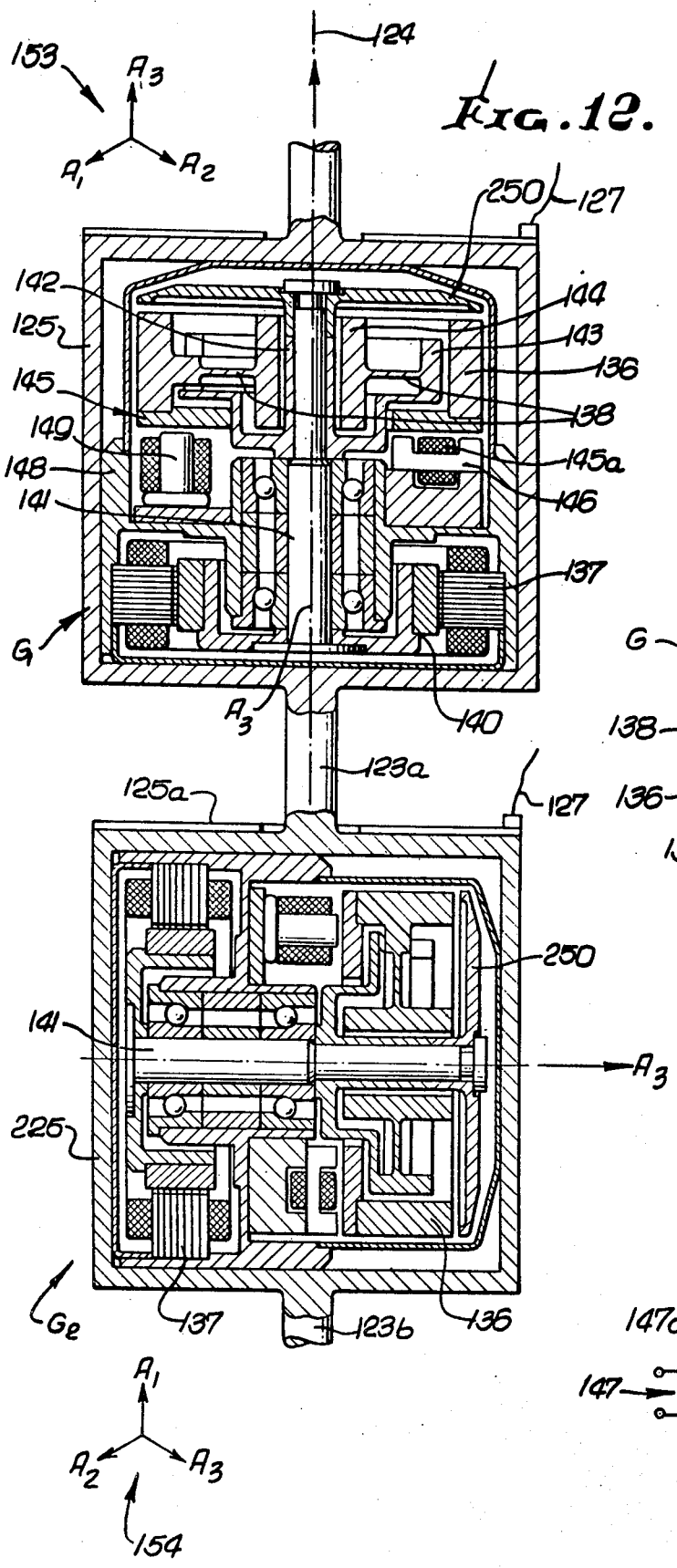
Figure 12A:
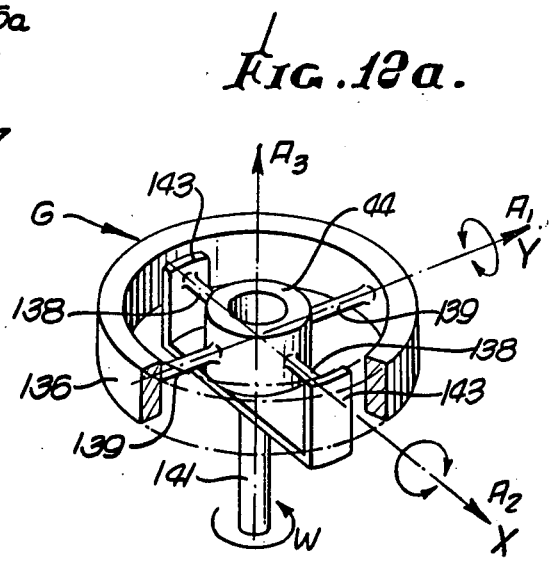

Turning now to FIG. 12, the gyroscopes $G_1$ and $G_2$ are of compact, highly reliable construction, and each is characterized as having a spinning rotor or wheel (as at 136), and torsion structure defining an inner gimbal. Further, the rotor spin frequency has a predetermined relation to a resonant frequency of the torsion structure. For example, the rotor 136 is typically driven at high speed by synchronous motor 137, through the gimbal which includes mutually orthogonally extending primary and secondary torsion members 138 and 139, also schematically indicated in FIG. **12*a*. In this regard, motor rotary parts 140 transmit rotation to shaft 141 onto which a sleeve 142 is pressed. The sleeve is joined to arm 143 which is connected via radially extending torsion members 138 to ring 144. The latter is joined via torsion members 139 to rotor or wheel 136. The rotor axis is generally coincident with axis 124. In FIGS. 12 and 12*a*** the axes are members of gyroscopes $G_1$ are related as follows:

$\dot{Y}$—direction axis $A_1$ defined by torsion members 139
$\overline{X}$—direction axis $A_2$ defined by torsion members 138
$\overline{Z}$—direction axis $A_3$ defined by shaft 141

Figure 12B:
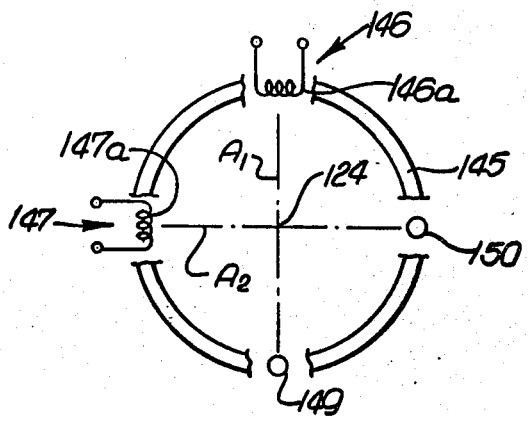

Auxiliary elements of $G_1$ include a magnetic armature 145 affixed to the rotor 136 to rotate therewith; pick-offs 146 and 147 affixed to the case 148 (attached to frame 125) to extend closely beneath the rotor so as to be inductively activated by the armature as it rotates about the $A_3$, (see pick-off coils **146*a* and 147*a*) and torque motors 149 and 150 affixed to the case. In FIG. 12, stops 250 on shafts 141 limit rotor gimbaling relative to the shafts, stops, pick-offs and torque motors. See the schematic of FIG. 12*b* which relates the positions of the torque motors and pick-offs to the armature, in quadrant relationship. The torque motors enable precessional or rebalanced torques to be applied to the rotor, via armature 145**, on axes $A_1$, and $A_2$, which enable use of the gyro as a servoed rate gyro.

The construction is such that the need for ball bearings associated with gimbaling of the rotor is eliminated, and the overall size of the gyroscope is reduced, and its output accuracy enhanced. The speed of rotation of the rotor and the torsion characteristics of the members 138 and 139 are preferably such as to provide a "tuned" or resonant dynamic relationship so that the rotor tends to behave like a free gyro in space. In addition, the angular position of the wheel relative to the housing (i.e. about axes $A_1$ and $A_2$) may be detected by the two orthogonal pick-offs (thus to the extent the rotor tends to tilt about axis $A_2$ toward one pick-off, its output is increased, for example, and to the extent the rotor tends to tilt about axis $A_1$ toward the other pick-off its output is increased, for example). Therefore, gimbaling of the rotor is accurately sensed, as the gyroscope $G_1$ and its frame 125 are rotated about axis 124 by motor 122. In practice, the deflection of the wheel is quite limited, due to servo-rebalancing through the torque devices.

The FIG. 12 gyroscope $G_2$ is shown as having the same construction as $G_1$; however axes $A_1$, $A_2$ and $A_3$ of the two gyros are related as shown by the schematically orthogonal arrow groups 153 and 154 in FIG. 12. Thus, the axis $A_3$ of the first gyro $G_1$ extends parallel to the one axis 124 which is the axis of rotation of the frames 125 and 225 produced by motor 122; and the axis $A_3$ of the second gyro $G_2$ is normal to axis 124. The pick-offs 146 and 147 provide means to detect rotor pivoting about at least one, and preferably either, of the input axes $IA_1$ and $IA_2$, in response to such rotation of the gyroscope frame, for each gyro. Thus, the output of either pick-off 146 and 147 of each gyro provides a signal $\omega_1$ was described in FIG. 1*a*.

Figure 11:
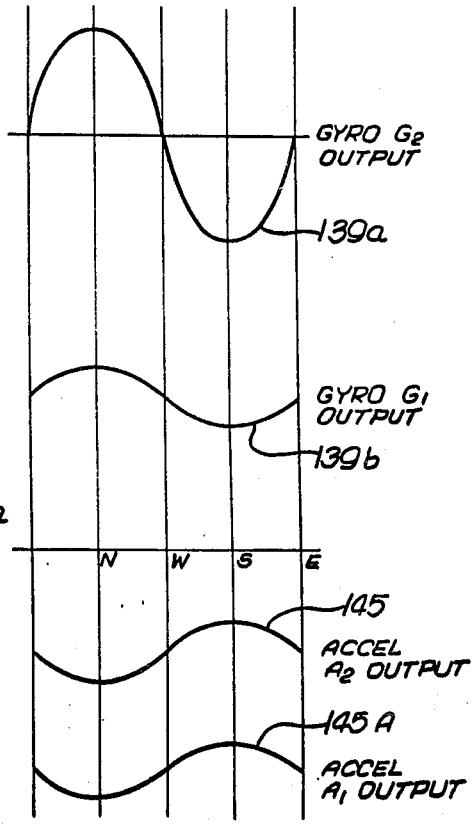

The outputs from the two gyros provide information which enables a "double check", or redundancy, as to azimuth relative to the instrument case or housing. Turning to FIG. 11, as the gyroscope $G_2$ is rotated about axis 124, its signal output 139*a*, as detected by pick-off 147, is maximized when its axis $A_3$ passes through the North-South longitudinal plane, and is least when that axis is closest to being normal to that plane. As the other gyrosope $G_1$ is rotated about axis 124, its signal output 139*b*, as detected by its pick-off 147, is maximized when its axis $A_3$ passes through the North-South longitudinal plane, and is least when that axis $A_3$ is closest to being normal to the plane. The values 139*a* and 139*b* are most accurate when corrected by compensation to correspond to the value $\omega_1'$ discussed above. Thus, for a non-vertical bore-hole, the two gyros will have outputs, and depending upon the latitude of the bore-hole, the two outputs will vary; however, they will tend to confirm each other, one or the other providing a stronger output. One usable gyroscope is Model GAM-1, a product of Societe de Fabrication de Instruments de Mesure, 13 Av. M. Ramolfo-Garner 91301 Massy, France.

Further, although each gyroscope $G_1$ and $G_2$ is a "two-axis" gyro (i.e. capable of rotation about either axis $A_1$, and $A_2$) it can be operated as a single degree of freedom gyro (i.e. made rotatable as described about only one of the axes $A_1$ and $A_2$) through use of the torque motors.

Figure 10:
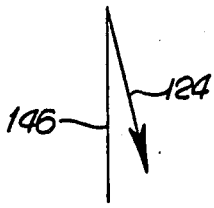

The accelerometer 226, which is simultaneously rotated with the gyroscope, has an output as represented for example at 145 in FIG. 11 under tilted conditions corresponding to tilt of axis 124 in North-South longitudinal plane; i.e., the accelerometer output is maximized when the $G_2$ gyroscope output indicates South alignment, and again maximized when the gyroscope output indicates North alignment. FIG. 10 shows tilt of axis 124 from vertical 146, and in the North-South plane, for example. Further, the accelerometer maximum output is a function of the degree of such tilt, i.e. is higher when the tilt angle increases, and vice versa; therefore, the combined outputs of the gyroscope and accelerometer enable ascertainment of the azimuthal direction of bore-hole tilt, at any depth measured lengthwise of the bore-hole and the degree of that tilt. The operation of accelerometer 126 is the same as that of 226, and is shown at 145*a* in FIG. 11, both being rotated by motor M at the same rate.

Figure 13:
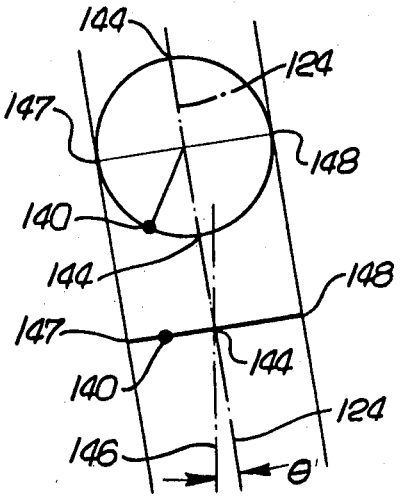

FIG. 13 diagrammatically illustrates the functioning of either accelerometer in terms of rotation of a sensitive axis (indicated by locus 140) in a plane and about axis 124 tilted at angle $\theta$ from vertical 146. As the locus rotates through points 144 at the level of the intersection of axis 124 and vertical 146, its rate of change of velocity in a vertical direction is zero; however, as the locus rotates through points 147 and 148 at the lowest and highest levels of its excursion, its rate of change of velocity in a vertical direction is at a maximum, that rate being a function of the tilt angle $\theta$. A suitable accelerometer is that known as Model 4303, a product of Systron-Donner Corporation, of Concord, Calif.

Control of the angular rate of rotation of shaft 123 about axis 124 may be from a surface control equipment indicated at 150, and circuitry 129 connected at 180 with the motor. Means (as for example a rotary table 81) to rotate the drill pipe 110 during well mapping, as described, is shown in FIG. 9.

Figure 16:
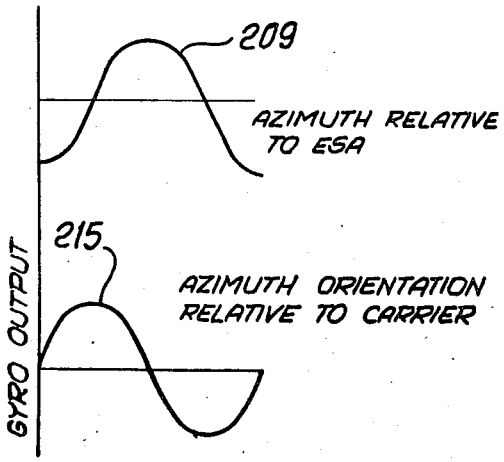

Referring to FIG. 9 and 16 either gyroscope is characterized as producing an output $\omega_1$ which varies as a function of azimuth orientation of the gyroscope relative to the earth's spin axis, that output for example being indicated at 209 in FIG. 16 and peaking when North is indicated. Most accurate peaking is indicated when the rate gyroscope output has been compensated as described above. Shaft 123 may be considered as a motor rotary output element which may transmit continuous unidirectional drive to the gyroscopes, or incremental continuous drive to pre-selected angular positions. Alternatively, the shaft may transmit cyclically reversing rotary drive to the gyroscopes, with or without incremental stopping at pre-selected angular positions. Further, the structure 122 in FIG. 9 may be considered as including servo means responsive to the gyroscope output to control the shaft 123 so as to maintain the gyroscopes predetermined azimuth orientation, i.e., the output axis of gyroscope $G_2$ for example may be maintained with direction such that the output 209 in FIG. 16 remains at a maximum or any other desired level.

As shown in FIG. 9 is circuitry 210, which may be characterized as a position pick-off, for referencing the gyroscope and accelerometer outputs to the case or housing 118. Thus, that circuitry may be connected with the motor (as by wiper 211 on shaft 123*d* turning with the gyroscope frames 125 and 225 and with shaft 123), and also connected with the carrier 118 (as by slide wire resistance 212 integrally attached to the carrier) to produce an output signal at terminal 214 indicating azimuthal) orientation of the gyroscopes relative to the carrier. That output also appears at 215 in FIG. 16. As a result, the output as terminal 214 may be processed (as by surface means generally shown at 216 connected to the instrumentation by cable 13) to determine or derive azimuthal data indicating orientation of the carrier or housing 118 relative to the earth's spin axis. Such information is often required, as where it is desired to know the orientation of well logging apparatus being run in the well.

In this regard, each gyro produces an output as reflected in its gimbaling, which varies as a function of azimuth orientation of the gyro relative to the earth's spin axis. The position pick-off, in referencing the gyroscope to the frame 118 produces an output signal at the pick-off terminal indicating azimuthal orientation of the gyro and accelerometer relative to the carrier or frame.

Item 220 in FIG. 9 may be considered, for example, as well logging apparatus the output of which appears at 221. Carrier 118 supports item 220, as shown. Merely for purpose of illustration, such apparatus may comprise an inclinometer to indicate the inclination of the bore-hole from vertical, or a radiometer to sense radiation intensity in the hole.

It will be understood that the recorder apparatus may be at the instrument location in the hole, or at the surface, or any other location. Also, the control of the motor 129 may be pre-programmed or automated in some desired manner.

Figure 14:
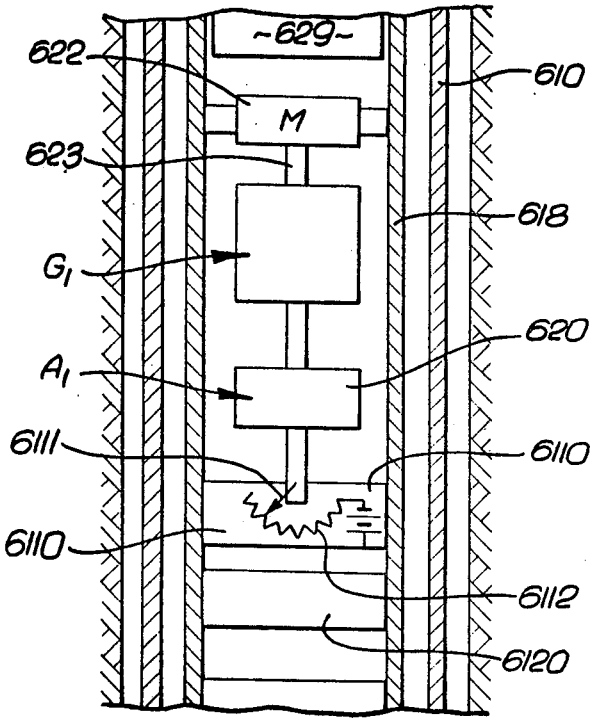
Figure 15:
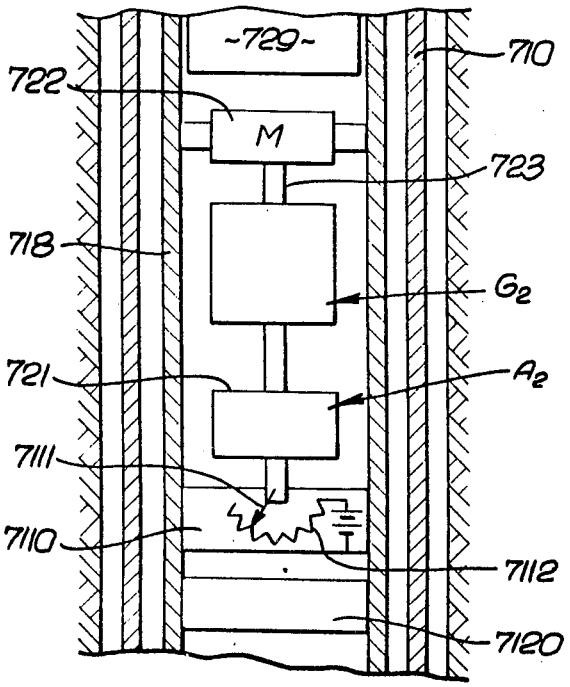

FIGS. 14 and 15 show the separate and individual use of the gyroscopes $G_1$ and $G_2$ (i.e. not together) in combination with drive motors 622 and 722, and accelerometers or tilt sensitive devices 620 and 721, respectively. Other elements corresponding to those in FIG. 9 bear the same numbers but are preceded by a 6 or 7, as respects FIGS. 14 and 15. The operations of the gyroscopes $G_1$ and $G_2$ in FIGS. 14 and 15 are the same as described in FIG. 9.

Figure 18:
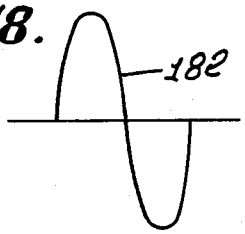
Figure 17:
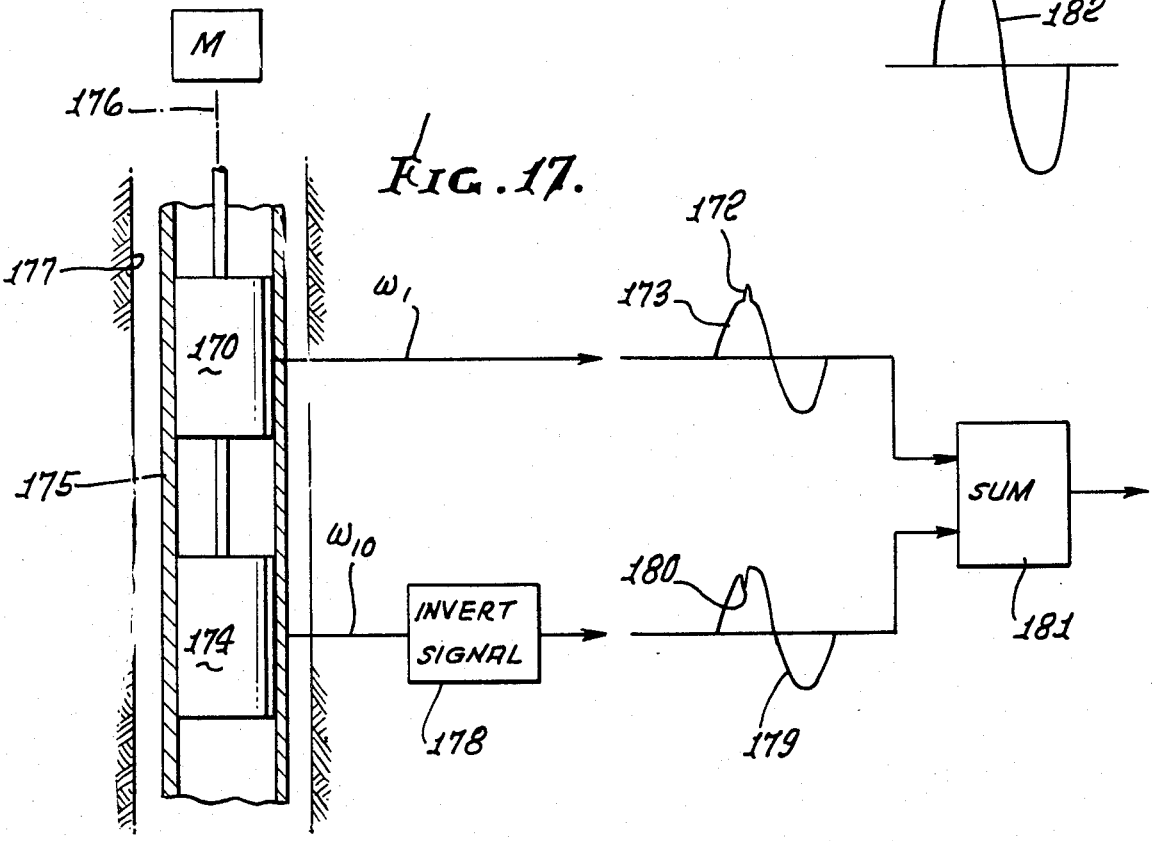

FIGS. 17 and 18 illustrate the use of one angular rate gyroscope 170 to produce an angular rate signal $\omega_1$ having an angular acceleration error 172 in its output wave form 173. That error derives from the servo and cultural noise in rotational modes, as well as start-ups and slow-downs, in incremental mode. A second angular rate gyroscope 174 is rotated with gyroscope 170 (as on a common carrier 175 rotated about an axis 176 generally parallel to the bore-hole 177 as for example is described above). That gyro's sensitive axis is inverted from that of the first gyro, but it has the same angular acceleration sensitivity sign. Accordingly, its output $\omega_{10}$ is passed through an inverting circuit 178, so that in its output wave form 179 the same error 180 (due to angular acceleration) shows up, but is inverted. When the outputs of the two gyros are summed at 181, not only do the two errors cancel, but the resultant amplitude is increased, as is clear from resultant wave form 182 seen in FIG. 18. Further the second redundant gyroscope enhances reliability, to enable continued operation in the bore-hole (without requiring a "round trip" pull-out of the string) and avoiding expense, in the event of failure of one gyro in the hole. Summing represents compensation.

Further, in holes with high temperature ranges, such multiple gyros are usable with one adjusted (or its output adjusted) to be optimized at one temperature, another at a second temperature and so forth. One important optimization would be floatation temperature, for instance. One also could take advantage of two gyros having two cant angles, or one without cant and one with, so as to have the best ability to measure various titlts and directions in a diverting bore-hole. Gyros 170 and 174 may be considered to represent such temperature adjusted gyros, or canted gyros.

Figure 20:
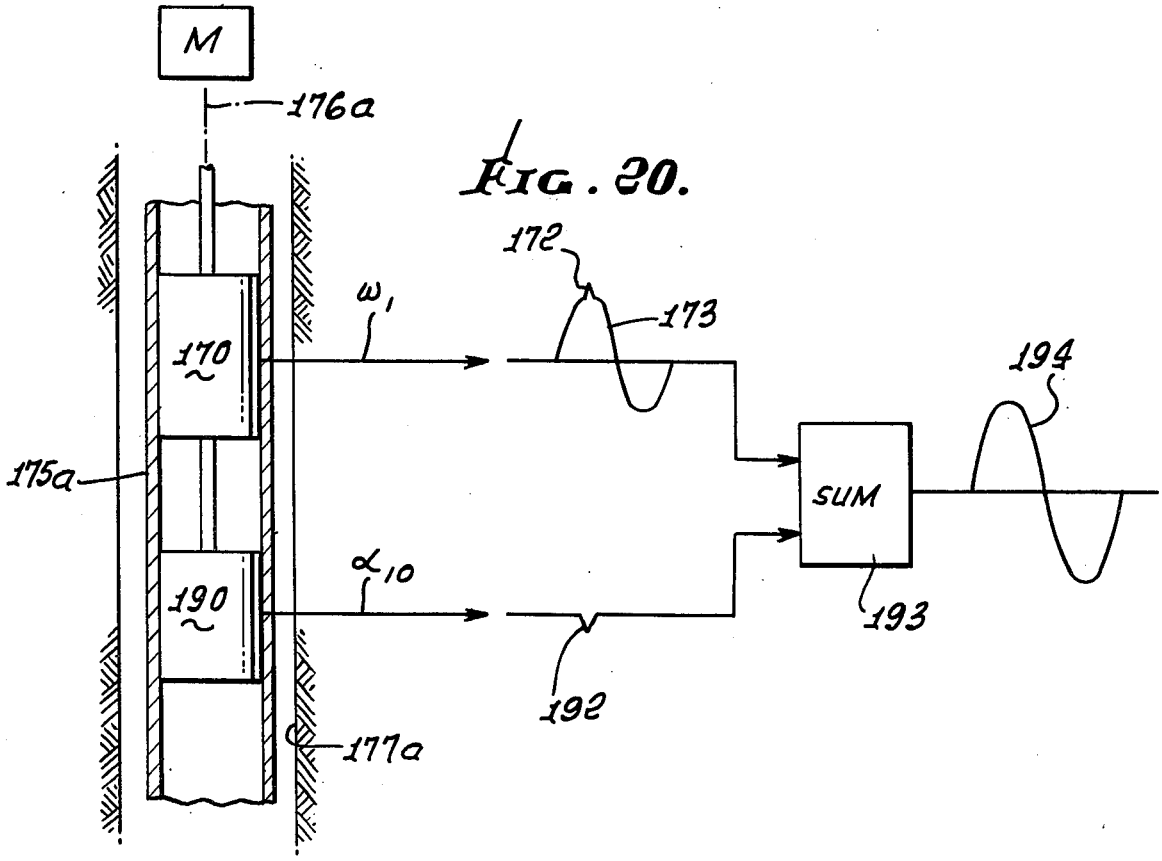

FIG. 20 illustrates the use of an angular rate gyroscope 170 to produce an angular rate signal $\omega_1$ having an angular acceleration error 173 in its output wave form 173, the same as described above in FIG. 17. An angular accelerometer 190 is rotated with gyroscope 170 (as on a common carrier 175*a* rotated about an axis 176*a* generally parallel to the bore-hole 177*a*, as for example is described above). That accelerometer's output $\alpha_{10}$ includes "error" 192 (due to change in angular acceleration), and is inverted relative to error 172. When the two outputs are summed at 193, the errors cancel, as is clear from the resultant wave form 194. Summing here represents compensation of output $\omega_1$ by the output $\alpha_{10}$ of acceleration 190.

The following commercial devices, as identified, are usable for the described sensors, including angular rate sensors and accelerometers:

| Single Axis Rate Sensor | |
|---|---|
| Vibrating Wire Rate Sensor | Honeywell Model GG1102 |
| Jet Stream Rate Gyro (solid state rate sensor) | Hamilton Standard Superjet |
| Laser Gyro | Honeywell Model GG1324 |
| Sonic Gyro | AC Delco Division of General Motors |
| Nuclear Spin Rate Gyro | Litton NMR Gyros |
| **Two Axis Rate Sensor** | |
| Magnet hydrodynamic Rate Sensor (MHD) | Honeywell Model GG250 |
| Dual Axis Rate Transducer (DART) | British Aircraft Co. Model 408 |
| Dynamically Tuned Gyro (DTG) | Incosym, Inc. Incoflex |
| Dynamically Tuned Gyro (DTG) | Northrop Model GT-B2 |
| Differentiated Position Gyro (ESG) | North American Micron Gyro |
| Differentiated Free Gyro | Systron Donner PKF-3 |
| **Combination Rate Sensor and Accelerometer** | |
| Rate Sensor and Accelerometer | Litton Multisensor |
| **Angular Accelerometer** | |
| Angular Accelerometer | Systron Donner Model 4596 |
| **Stable Platforms (Differentiate Angular Position To Get Angular Rate)** | |
| Gimbal Stable Platform | Litton AHARS: LTR-80 |
| Strapdown Stable Platform | Northrop NIS-210 |

Figure 19:
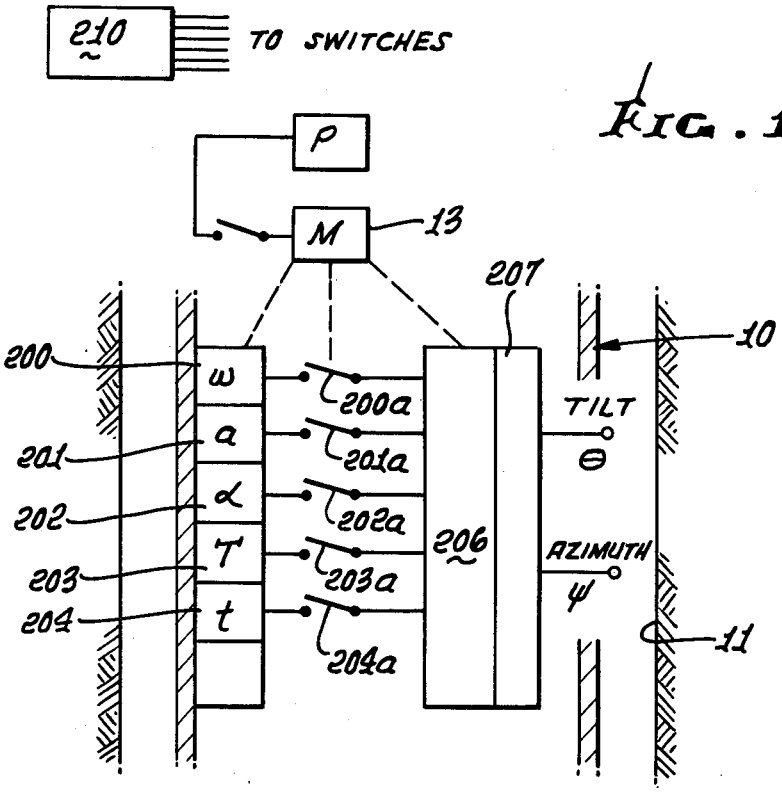

FIG. 19 shows, generally, a carrier 10 in a bore-hole 11, a drive 13 to rotate the carriage and a power source P to selectively energize the drive, if rotation is desired. These elements are suspended in the bore-hole, to be lifted and lowered, as in FIG. 1.

Within the carrier are signal sources indicated as blocks 200–204 to generate signals $\omega$, a, $\alpha$, T and t, as described above. Those signals are selectively transmitted via switches 200*a*–104*a* to compensation circuitry 206, for selective compensation, for example as described above. The compensated signals are then processed in a omputer 207 to derive accurate indiations of tilt and aziumth, as shown. A master control 210, as at the surface, is operable to control the switches, as desired.

Figure 21:
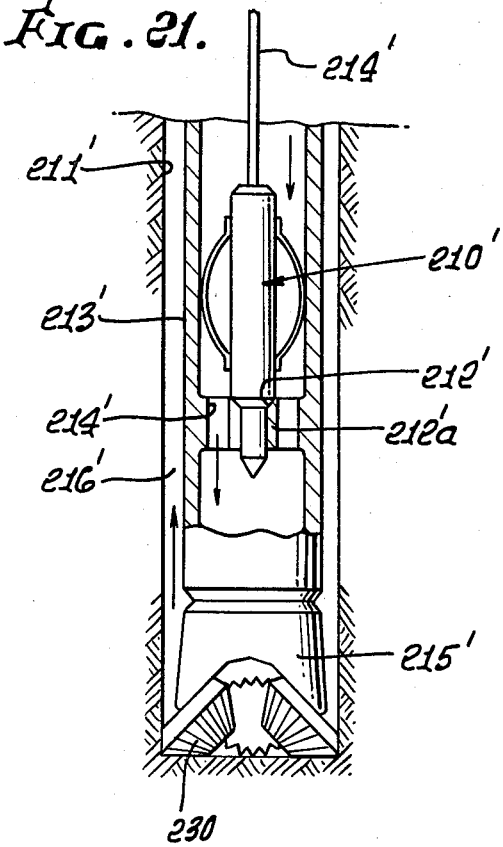

The apparatus and method described herein is useful for both mapping or surveying of a bore-hole, and also for steering of a tool in the hooe, as for example assisting in guiding of a drill bit to change its direction. FIG. 21 shows the instrument housing 210' (corresponding to housing 10 in FIG. 1*a*, housing 110 in FIG. 9, and housing 175 and 175*a* in FIGS. 17 and 20) lowered or pumped down a well or bore-hole 211' and landed at 212' on an angularly locating latching set structure 212'*a* integral with drill stem 213', and retaining the housing in a selected angular position relative to the stem. Drilling mud or fluid passes downwardly through openings 214' in the seat structure, for access to the drill bit 215' and lifting of cuttings in the annulus 216. Rotation of the drill stem rotates the instrument to provide the rotary motion or input to the instrument. Thus, the instrument enables sensing of the azimuth and tilt of the drill stem and bore-hole at the drill location. Retrieval of the instrument is enabled by wire line 214, wherever required. Once the tilt, depth and azimuth of the hole at drill location is known, a shoe or other device may be employed in the hole to deflect or steer the drill in the desired direction. Hole depth may be determined from the length of drill pipe in the hole. The drill bit is indicated at 230.

Figure 22:
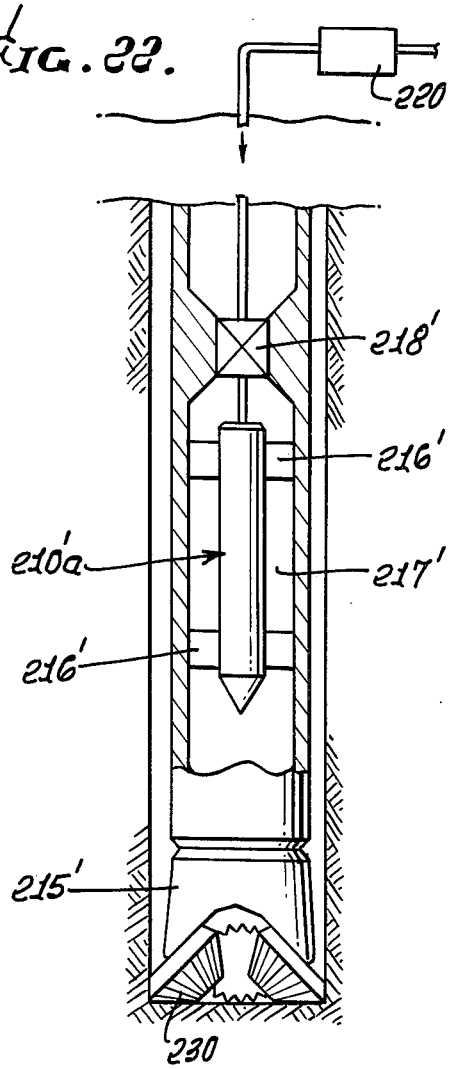

FIG. 22 is like FIG. 21, except that the instrument case 210*a*' is mounted to the drill stem, as for example by ribs 216' or other means, allowing passage of drilling fluid downwardly at 217' to the drill bit. Signals are transmitted upwardly to the surface from the instrument 210*a* as via suitable means. For example, a valve 218' in the path of the fluid may be opened or closed (in accordance with azimuth and tilt data from instrument 201a'), and that opening and closing movement sensed at the surface via fluid flow detector 220.

Figure 24:
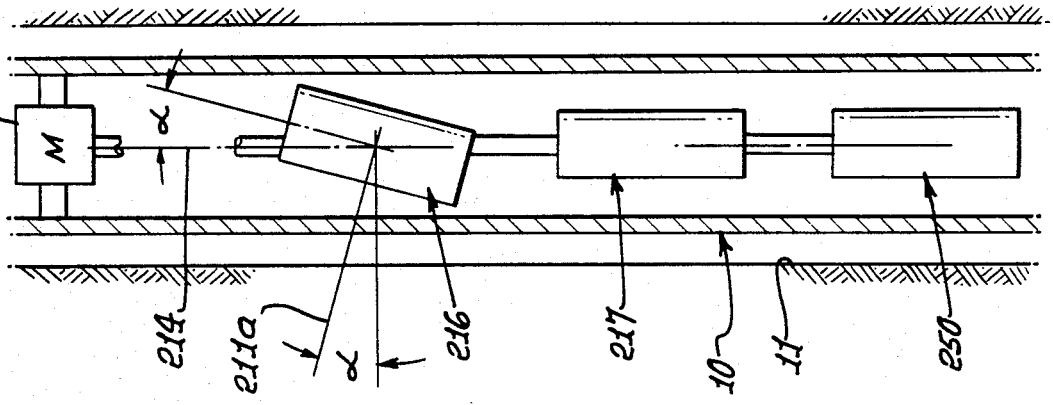

FIG. 24 shows an angular rate sensor or sensors 216 such as appear at 16 in FIG. 1*a;* a linear accelerometer or accelerometers 217 as appear at 17 in FIG. 1*a;* and an angular rate accelerometer or accelerometers 250 as appear at 150 in FIG. 1*a.* A common drive to rotate these devices in a bore-hole 11 appears at 213 and corresponds to drive 13 in FIG. 1*a.* The difference over FIG. 1*a* lies in the cant of the sensor or sensors 216 relative to the axis 214 of rotation (see angle $\alpha$, or the cant angle $\alpha$ of the sensitive axis 216*a* relative to horizontal or relative to the devices 217 and 250 which are not canted).

Figure 28:
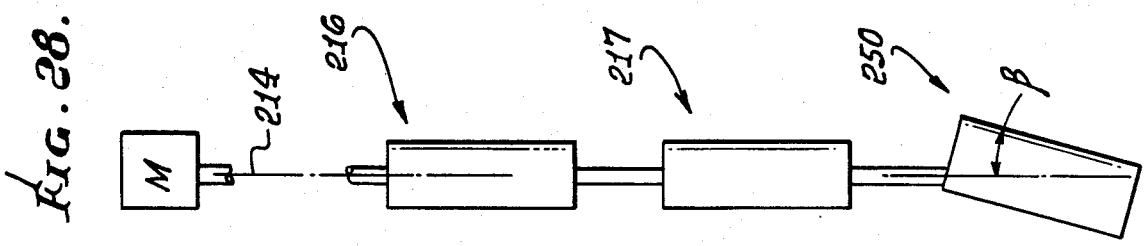
Figure 27:
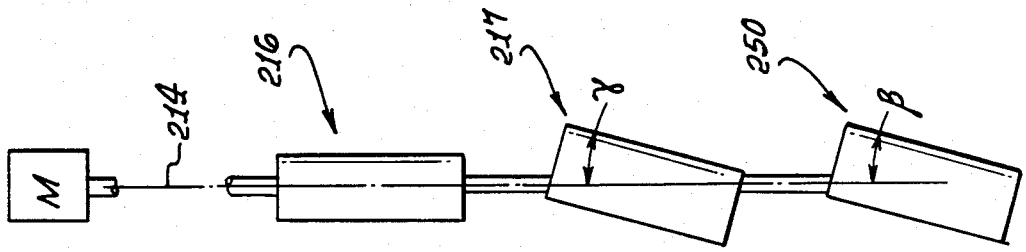
Figure 26:
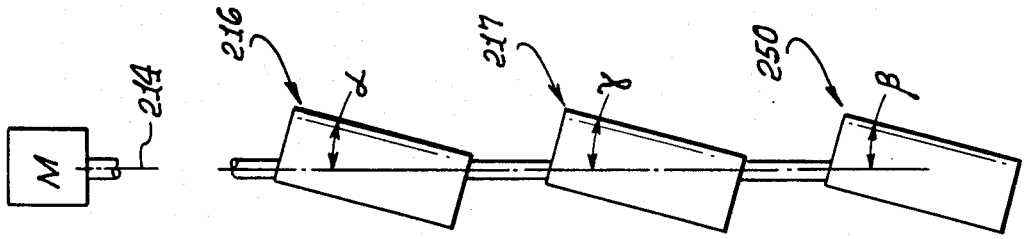
Figure 25:
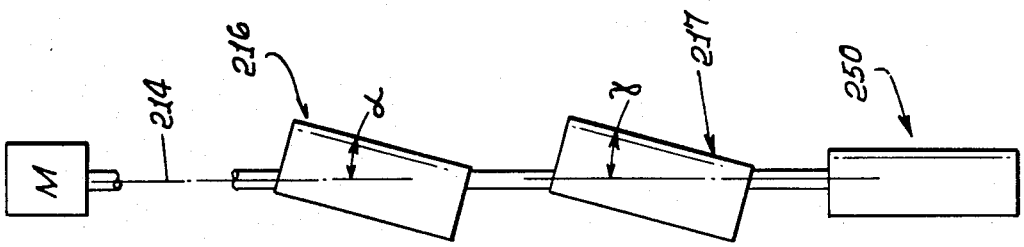

FIG. 25 is like FIG. 24, except that device 217 is also canted, at angle $\gamma$; FIG. 26 is like FIG. 24, except that device 250 is also canted at angle $\beta$; FIG. 27 is like FIG. 27 except that device 216 is not canted relative to axis 214; and FIG. 28 is like FIG. 27 except that device 217 is not canted relative to axis 214. Angles $\alpha$, $\gamma$ and $\beta$ may or may not be the same.

A free gyroscope may also be combined with the angular rate sensor or gyroscope disclosed herein, in the manner described in applicant's U.S. Pat. No. 4,192,077, and for that purpose the box 17 may be considered to represent:

(a) an angle reference device (such as a free gyroscope) carried for movement along a travel axis in a bore hole, that device having a calibratable component, (b) first means (such as an angular rate sensor) having an output for effecting calibration of that component, and (c) control means connected with the first means to cause the first means to periodically effect calibration of that component.

Block 17 may also be considered to represent a dual gimballed angular rate gyroscope system as disclosed in U.S. Pat. No. 4,197,654, with the output of either or both gyroscopes compensated as disclosed herein. As disclosed in that prior patent, two angular rate gyros are respectively rotatable about axes which are mutually perpendicular.

In the aobve, the sensors (as for example are shown in FIGS. 1*a,* 9 and other views, may be rotated by the indicated drive motor, or motors, or the tubing or drill stem, in any of several modes, including continuously, incrementally, cyclically, and forwardly and reversely.

We claim:

1. In apparatus for determining aximuth and tilt in a bore-hole, (a) a carrier movable in the bore-hole, (b) angular rate sensor means on the carrier and having an output, (c) an acceleration sensor means on the carrier and having an output, (d) means to rotate said sensor means, and (e) circuit means operatively connected with the sensor means for compensating signals derived from the output of at least one of the sensor means in accordance with the values of signals derived from the output of the other sensor means, to produce compensated signals, (f) said circuit means connected with both said angular rate and said acceleration sensor means to adjust angular rate signals derived from the output of the angular rate sensor thereby to compensate for acceleration effects associated with acceleration signals derived from the output of the acceleration sensor means, so as to produce corrected angular rate values, (g) and temperature compensating circuit means connected with both said angular rate and said acceleration sensor means to compensate signals derived therefrom in accordance with temperatre changes encountered in the bore hole.

2. The apparatus of claim 1 wherein said circuit means includes summing circuitry to sum an angular rate signal $\omega$ along a selected coordinate axis, and a signal Da along said axis, where "D" is a constant and "a" is a value corresponding to the output of the acceleration sensor means, along said axis.

3. The apparatus of claim 1 wherein said circuit means includes summing circuitry to sum angular rate signals $\omega_1$, $\omega_2$ and $\omega_3$ along three selected axes associated with the angular rate sensor means, with, respectively, acceleration signals $D_1 a_1$, $D_2 a_2$ and $D_3 a_3$ along said axes, where $D_1$, $D_2$ and $D_3$ are constants, and $a_1$, $a_2$ and $a_3$ are values corresponding to acceleration outputs along said three selected axes, respectively, of the acceleration sensor means.

4. The apparatus of claim 1 wherein said (d) means is located to rotate the carrier in the bore-hole and about an axis extending generally in the direction of the bore-hole.

5. The apparatus of claim 1 including coordinate conversion circuit means operatively connected with said acceleration sensor means to convert outputs of the acceleration sensor means along three axes of said values $a_1$, $a_2$ and $a_3$ along said three selected axes.

6. The apparatus of claim 1 including means operatively connected with said circuit means to receive said corrected angular rate values and to produce an output which varies as a function of azimuth orientation of the angular rate sensor means.

7. The apparatus of claim 1 wherein said circuit means is connected with the sensor means to adjust acceleration signals derived from the output of the acceleration sensor means to compensate for angular rate effects associated with angular rate signals derived from the output of the angular rate sensor means, thereby to produce corrected acceleration values.

8. The apparatus of claim 7 including means operatively connected with said circuit means to receive said corrected acceleration values and to produce an output which varies as a function of tilt of the acceleration sensor means.

9. The apparatus of claim 1 wherein said angular rate sensor means comprises at least one rate gyroscope.

10. The apparatus of claim 1 wherein said angular rate sensor means is canted relative to an axis defined by the bore hole.

11. The apparatus of claim 1 wherein said acceleration sensor means is canted relative to an axis defined by the bore hole.

12. In apparatus for determining azimuth and tilt, in a bore hole (a) a carrier movable in the bore-hole, (b) angular rate sensor means on the carrier and having an output, (c) an acceleration sensor means on the carrier and having an output, and (d) circuit means operatively connected with the sensor means for compensating signals derived from the output of at least one of the sensor means, for use of such compensated signals in conjunction with signals derived from the other of the sensor means, (e) said circuit means being connected with both of said angular rate sensor means and said acceleration sensor means to adjust angular rate signals derived from the output of the angular rate sensor thereby to compensate for angular acceleration effects associated with angular acceleration signals derived from the output of the acceleration sensor means, so as to produce corrected angular rate values, (f) and temperature compensating circuit means connected with both said angular rate and said acceleration sensor means to compensate signals derived therefrom in accordance with temperature changes encountered in the bore hole.

13. The combination of claim 1 wherein said circuit means includes circuitry to sum the outputs of the (b) and (c) sensor means to substantially cancel error due to angular acceleration.

14. The apparatus of claim 12 wherein said circuit means includes summing circuitry to sum an angular rate signal $\omega$ along a selected coordinate axis, and a signal $K\alpha$ along said axis, where "K" is a constant and "$\alpha$" is a value corresponding to the output of the acceleration sensor means, about said axis.

15. The apparatus of claim 12 wherein said circuit means includes summing circuitry to sum angular rate signals $\omega_1$, $\omega_2$ and $\omega_3$ along three selected axes associated with the angular rate sensor means, with, respectively, acceleration signals $K_1\alpha_1$, $K_2\alpha_2$ and $K_3\alpha_3$ along said axes, where $K_1$, $K_2$ and $K_3$ are constants, and $\alpha_1$, $\alpha_2$ and $\alpha_3$ are values corresponding to angular acceleration outputs along said three selected axes, respectively, of the acceleration sensor means.

16. The apparatus of claim 1 including time compensating circuit means to compensate signals derived from at least one of the sensor means (b) and (c) of claim 1 in accordance with time values.

17. The apparatus of claim 16 including means operatively connected with said circuit means to receive said corrected angular rate values and to produce an output which varies as a function of azimuth orientation of the angular rate sensor means.

18. The combination of claim 1 wherein said acceleration sensor means includes:

(i) a linear acceleration sensor means, and (ii) an angular acceleration-sensor means.

19. The apparatus of claim 18 wherein said circuit means is connected with the sensor means to adjust angular rate signals derived from the output of the angular rate sensor thereby to compensate for linear and angular acceleration effects associated with acceleration signals derived from the output of the acceleration sensor means, so as to produce corrected angular rate values.

20. The apparatus of claim 19 wherein said circuit means includes summing circuitry to sum an angular rate signal $\omega$ along a selected coordinate axis, and a signal Da along with axis, where "D" is a constant and "a" is a value corresponding to the output of the linear acceleration sensor means, along said axis, and also to sum said angular rate signal $\omega$ and a signal $K\alpha$ along said axis, where "K" is a constant and "$\alpha$" is a value corresponding to the output of the angular acceleration sensor means about said axis.

21. The method of mapping a bore-hole, including (a) suspending within the hole angular rate sensor means and acceleration sensor means, each of said sensor means having an output, (b) rotating said sensor means in the bore-hole, and (c) operating said sensor means to provide outputs, and (d) using the output from one sensor means to compensate the output of the other sensor means, (e) said angular rate signals being derived from the output of the angular rate sensor means and acceleration signals are derived from the output of the acceleration sensor means, and said (d) step includes using said acceleration sensor signals to adjust said angular rate signals to correct same, (f) and compensating the signals derived from at least one of said sensor means in accordance with temperature encountered in the bore hole.

22. The method of claim 21 wherein said signals have associated co-ordinates, and including the step of adjusting the co-ordinates of said angular rate and acceleration signals to conform to the co-ordinates of the other of said angular rate and acceleration signals.

23. The method of claim 21 wherein said sensor means have sensitive axes, and said suspending step includes orienting the sensitive axis of at least one sensor means in general alignment with the bore-hole.

24. The method of claim 22 wherein said suspending step includes orienting the sensitive axes of multiple of said sensor means in predetermined relation with the bore-hole.

25. The method of claim 21 wherein said sensor means have sensitive axes, and said suspending step includes orienting the sensitive axis of at least one of the sensor means at a cant angle relation to the bore-hole direction of elongation.

26. The method of claim 21 wherein signals are derived from said sensor outputs, and including the step of compensating certain of said signals in accordance with time values.

27. The method of claim 21 wherein said (b) step rotation is about an axis extending generally in the direction of the bore-hole.

28. The method of claim 21 including employing the outputs of the sensor means, including said compensated output, to determine azimuth and degree of tilt of the bore-hole at the location of the sensor means therein when the outputs are produced.

29. The method of claim 21 wherein acceleration signals are derived from the output of the acceleration sensor means, and angular rate signals are derived from the output of the angular rate sensor means, and said (d) step includes using said angular rate signals to adjust said acceleration signals, to modify same.

30. The method of claim 21 wherein said angular rate sensor means comprises angular rate gyroscope means, and including the step of allowing said gyroscope means to turn about a sensitive axis in response to said (b) step rotation, to produce said output.

31. The method of claim 21 wherein said rotation is carried out continuously.

32. The method of claim 21 wherein said rotation is carried out incrementally.

33. The method of claim 21 wherein said rotation is carried out cyclically.

34. The method of claim 21 wherein said rotation is carried out alternatively forwardly and reversely.

35. The method of claim 21 wherein, (i) certain of said acceleration signals are derived as linear acceleration signals, and (ii) other of said acceleration signals are derived as angular acceleration signals.

36. The apparatus of claim 1 wherein said (c) means includes a drive to effect rotation of the sensor means in one of the following modes: continuous, incremental, cyclical, and alternate forward and reverse.

37. The apparatus of claim 1 wherein said (c) means comprises a second angular rate sensor means.

38. The apparatus of claim 37 wherein said (b) and (c) sensor means comprises angular rate gyroscopes.

39. The apparatus of claim 38 wherein said circuit means includes an inverter to invert an error signal in the output of the second gyroscope, and a summing circuit to sum the outputs of the two gyroscopes to cancel an error signal in the output of the first gyroscope by summation with the inverted error signal in the output of the second gyroscope.

40. The apparatus of claim 1 wherein said (c) means comprises an angular accelerometer.

41. The apparatus of claim 1 wherein said circuit means is connected with the sensor means to adjust linear acceleration signals derived from the output of the acceleration sensor thereby to compensate for angular rate effects associated with angular rate signals derived from the output of the angular rate sensor means, so as to produce corrected linear acceleration values.

42. The apparatus of claim 1 wherein said circuit means is connected with the sensor means to adjust angular acceleration signals derived from the output of the acceleration sensor thereby to compensate for angular rate effects associated with angular rate signals derived from the output of the angular rate sensor means, so as to produce corrected angular acceleration values.

43. The apparatus of claim 1 wherein said circuit means is connected with the sensor means to adjust angular rate signals derived from the output of the angular rate sensor thereby to compensate for linear and angular acceleration effects associated with linear and angular acceleration signals derived from the output of the acceleration sensor means, so as to produce corrected angular rate values.

44. The combination of claim 1 including an angle reference device on the carrier and connected to be calibrated in accordance with the output of the angular rate sensor means.

45. The combination of claim 44 wherein said angle reference device comprises one of the following: a gyroscopically stabilized platform, electronic gimballing circuitry, and mechanical gimballing means.

46. The apparatus of claim 1 including time compensating circuit means to compensate signals derived from at least one of the sensor means (b) and (c) of claim 1 in accordance with time values.

47. The apparatus of claim 12 wherein said (d) means also includes co-ordinate transformation circuitry.

* * * * *